US009316950B2

(12) United States Patent
Takahashi et al.

(10) Patent No.: US 9,316,950 B2
(45) Date of Patent: Apr. 19, 2016

(54) DEVELOPMENT DEVICE, PROCESS CARTRIDGE, IMAGE FORMING APPARATUS INCORPORATING SAME, AND DEVELOPER AMOUNT ADJUSTMENT METHOD THEREFOR

(71) Applicants: Tomoko Takahashi, Kanagawa (JP); Yoshiyuki Fukuda, Tokyo (JP); Yoshio Hattori, Kanagawa (JP); Sho Akiyama, Tokyo (JP); Takamasa Ozeki, Kanagawa (JP); Yoshinori Nakagawa, Kanagawa (JP); Mikio Ishibashi, Kanagawa (JP); Ryuji Yoshida, Kanagawa (JP); Taichi Urayama, Kanagawa (JP)

(72) Inventors: Tomoko Takahashi, Kanagawa (JP); Yoshiyuki Fukuda, Tokyo (JP); Yoshio Hattori, Kanagawa (JP); Sho Akiyama, Tokyo (JP); Takamasa Ozeki, Kanagawa (JP); Yoshinori Nakagawa, Kanagawa (JP); Mikio Ishibashi, Kanagawa (JP); Ryuji Yoshida, Kanagawa (JP); Taichi Urayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/856,541

(22) Filed: Apr. 4, 2013

(65) Prior Publication Data

US 2014/0301747 A1 Oct. 9, 2014
US 2016/0041494 A9 Feb. 11, 2016

(30) Foreign Application Priority Data

Apr. 17, 2012 (JP) ..... 2012-093773
Jul. 27, 2012 (JP) ..... 2012-167124
Oct. 26, 2012 (JP) ..... 2012-236348

(51) Int. Cl.
*G03G 15/09* (2006.01)

(52) U.S. Cl.
CPC ..... *G03G 15/0921* (2013.01)

(58) Field of Classification Search
CPC ..... G03G 15/0822; G03G 15/0824
USPC ..... 399/53, 58
See application file for complete search history.

(56) References Cited

U.S. PATENT DOCUMENTS

| | | | | |
|---|---|---|---|---|
| 7,493,058 | B2 * | 2/2009 | Takeuchi et al. | 399/58 |
| 2006/0150902 | A1 * | 7/2006 | Stelter et al. | 118/621 |
| 2008/0085137 | A1 | 4/2008 | Suzuki | |
| 2008/0286015 | A1 | 11/2008 | Kadota et al. | |
| 2009/0016781 | A1 | 1/2009 | Takahashi et al. | |

(Continued)

FOREIGN PATENT DOCUMENTS

| | | |
|---|---|---|
| JP | 5-333691 | 12/1993 |
| JP | 11-174810 | 7/1999 |

(Continued)

*Primary Examiner* — Gregory H Curran
(74) *Attorney, Agent, or Firm* — Harness, Dickey & Pierce

(57) ABSTRACT

A development device is operable in multiple different speed modes and includes a developer bearer to carry developer, a developer regulator to adjust an amount of developer carried on the developer bearer, and multiple developer conveyance members disposed facing the developer bearer to transport developer in a longitudinal direction to circulate developer inside the development device. The multiple developer conveyance members including a first developer conveyance member to supply developer to the developer bearer and a second developer conveyance member to transport developer collected from the developer bearer. The development device executes developer amount balance adjustment in which a driving velocity of at least the multiple developer conveyance members is increased from a driving velocity in a lower-speed mode for a predetermined period after image development in the lower speed mode is completed and before image development in a higher speed mode is started.

13 Claims, 11 Drawing Sheets

(56) References Cited

U.S. PATENT DOCUMENTS

| | | | |
|---|---|---|---|
| 2009/0052912 | A1 | 2/2009 | Soji et al. |
| 2009/0067879 | A1 | 3/2009 | Takahashi et al. |
| 2009/0067889 | A1 | 3/2009 | Nakagawa et al. |
| 2009/0136257 | A1 | 5/2009 | Hattori et al. |
| 2009/0245882 | A1 | 10/2009 | Ozeki et al. |
| 2009/0245889 | A1 | 10/2009 | Koetsuka et al. |
| 2009/0257786 | A1 | 10/2009 | Nakagawa et al. |
| 2009/0257791 | A1 | 10/2009 | Nakagawa et al. |
| 2009/0290901 | A1 | 11/2009 | Ishii et al. |
| 2010/0021214 | A1 | 1/2010 | Kadota et al. |
| 2010/0040393 | A1 | 2/2010 | Kawahara et al. |
| 2010/0104319 | A1 | 4/2010 | Saitoh et al. |
| 2010/0150615 | A1 | 6/2010 | Nakagawa et al. |
| 2010/0183342 | A1 | 7/2010 | Saitoh et al. |
| 2011/0043589 | A1 | 2/2011 | Hirota et al. |
| 2011/0058832 | A1 | 3/2011 | Suzuki et al. |
| 2011/0058858 | A1 | 3/2011 | Fukuda et al. |
| 2011/0194874 | A1 | 8/2011 | Masuda et al. |
| 2011/0217085 | A1 | 9/2011 | Hattori et al. |
| 2012/0155900 | A1* | 6/2012 | Suzuki ..... 399/53 |
| 2012/0163874 | A1 | 6/2012 | Hattori et al. |
| 2012/0219326 | A1 | 8/2012 | Koike et al. |
| 2013/0034368 | A1 | 2/2013 | Hattori et al. |
| 2013/0164009 | A1* | 6/2013 | Fukuoka ..... 399/53 |

FOREIGN PATENT DOCUMENTS

| | | |
|---|---|---|
| JP | 2003-323043 | 11/2003 |
| JP | 2008-026408 | 2/2008 |
| JP | 2011-028216 | 2/2011 |

* cited by examiner

DEVELOPMENT DEVICE, PROCESS CARTRIDGE, IMAGE FORMING APPARATUS INCORPORATING SAME, AND DEVELOPER AMOUNT ADJUSTMENT METHOD THEREFOR

CROSS-REFERENCE TO RELATED APPLICATIONS

This patent application is based on and claims priority pursuant to 35 U.S.C. §119 to Japanese Patent Application Nos. 2012-093773 filed on Apr. 17, 2012, 2012-167124 filed on Jul. 27, 2012, and 2012-236348 filed on Oct. 26, 2012, in the Japan Patent Office, the entire disclosure of each of which is hereby incorporated by reference herein.

BACKGROUND OF THE INVENTION

1. Field of the Invention

The present invention generally relates to a development device; and a process cartridge and an image forming apparatus, such as, a copier, a printer, a facsimile machine, or a multifunction machine including at least two of these functions that includes a development device; and, more particular, to adjustment of the amount of two-component developer in the development device.

2. Description of the Background Art

Two-component developer consisting essentially of toner particles and carrier particles is widely used in image forming apparatuses such as photocopiers, facsimile machines, printers, or multifunction machines having several of those capabilities. Two-component development devices typically include a development roller (i.e., a developer bearer), multiple developer conveyance members to transport developer in the longitudinal direction of the development device, thereby forming a developer circulation path, and a developer regulator to adjust the amount of developer carried on the development roller upstream from a development range where the development roller faces an image bearer such as a photoreceptor.

For example, developer can be circulated unidirectionally in the following configurations. An interior of the development device containing the respective components is separated by a partition (i.e., an inner wall) into multiple compartments or conveyance channels, and the partition is absent at the both ends in the longitudinal direction, thus securing communication areas through which developer moves from one conveyance channel to another conveyance channel.

Fresh toner is supplied through a toner supply inlet to the two-component development device as the toner inside the development device is consumed in image development. The supplied toner is mixed with the developer in the development device by the developer conveyance member, such as a screw, serving as a developer supply member, and then the mixed developer is partly supplied to a circumferential surface of the development roller. While the development roller rotates, the developer regulator (e.g., a doctor blade) disposed facing the development roller adjusts the amount of the developer carried on the development roller, and then the toner in the two-component developer adheres to a latent image formed on the image bearer in the development range.

There are development devices in which two developer conveyance members (first and second developer conveyance members), respectively serving as the developer supply member and a developer collecting member, are arranged vertically, forming a developer circulation channel.

Arranging the multiple developer conveyance members vertically is widely used in tandem multicolor image forming apparatuses in which multiple development devices are arranged horizontally because this arrangement can make the development device horizontally compact. Compared with an arrangement in which multiple conveyance members are arranged in parallel horizontally, this arrangement can better inhibit the developer that has been used in image development from being supplied to the developer bearer, thus reducing unevenness in image density.

For example, the developer regulator may be disposed facing an upper circumferential surface of the developer bearer, and the developer supply member may be disposed above the developer collecting member across the partition.

Alternatively, for example, JP-H11-174810-A proposes a configuration in which the developer regulator faces a lower circumferential surface of the developer bearer, and the developer supply member (first conveyance member) is beneath the developer collecting member (second conveyance member) across the partition.

The first conveyance member (lower conveyance member) supplies developer from a first conveyance channel onto the development roller at a position corresponding to an attraction magnetic pole generated by a magnet roller provided inside the development roller while transporting the developer longitudinally. The second conveyance member receives developer separated from the development roller at a position corresponding to a release magnetic pole and transport the developer in a second conveyance channel in the direction opposite the direction in which the first conveyance member transports the developer.

The first and second conveyance channels communicate with each other through first and second communication openings. The amount of developer decreases downstream in the supply channel in the developer conveyance direction therein, whereas the amount of developer increases downstream in the collection channel in the developer conveyance direction therein.

The configuration proposed in JP-H11-174810-A can inhibit increases in the load to the driving system caused to bring up developer against the gravity on the downstream side in the direction in which developer is transported, compared with the former configuration.

Additionally, there are image forming apparatuses that offer selection of image formation modes for forming high-quality images, forming images on thicker paper, and the like. In addition to temperature and speed of image fixing, image formation speed may be changed depending on the image formation mode. For example, image formation speed is slowed down to form high-quality images or to form images on thicker paper. By contrast, image formation speed is increased to accelerate consecutive copying or first print time.

Changes in image formation speed can affect the balance of the amount of developer in the development device. For example, the amount of developer carried on the development bearer may be equalized by leveling off the height of developer carried, which depends on the screw pitch of the developer conveyance screw.

SUMMARY OF THE INVENTION

In view of the foregoing, one embodiment of the present invention provides a development device configured to develop a latent image formed on a latent image bearer with two-component developer contained therein and includes a partition dividing, at least partly, an interior of the development device into a supply channel and a collection channel, a developer bearer to carry developer and disposed facing the latent image bearer, a developer regulator to adjust an amount of developer carried on the developer bearer, and multiple developer conveyance members to transport developer in a longitudinal direction of the development device and circulate developer inside the development device. The multiple developer conveyance members include a first developer conveyance member disposed facing the developer bearer to supply developer from a supply channel to the developer bearer, and a second developer conveyance member disposed facing the developer bearer to transport developer collected from the developer bearer in the collecting channel. The development device is operable in multiple different speed modes and performs developer amount balance adjustment. In the developer amount balance adjustment, a driving velocity of at least the multiple developer conveyance members is increased from a driving velocity in a lower-speed mode, and the development device executes the developer amount balance adjustment for a predetermined period after image development in the lower speed mode is completed and before image development in a higher speed mode is started.

Another embodiment provides a process cartridge configured to removably installed in an image forming apparatus and includes the above-described latent image bearer and the development device.

Yet another embodiment provides an image forming apparatus that includes the above-described latent image bearer and the development device.

Yet another embodiment provides a method for adjusting the amount of developer in a development device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
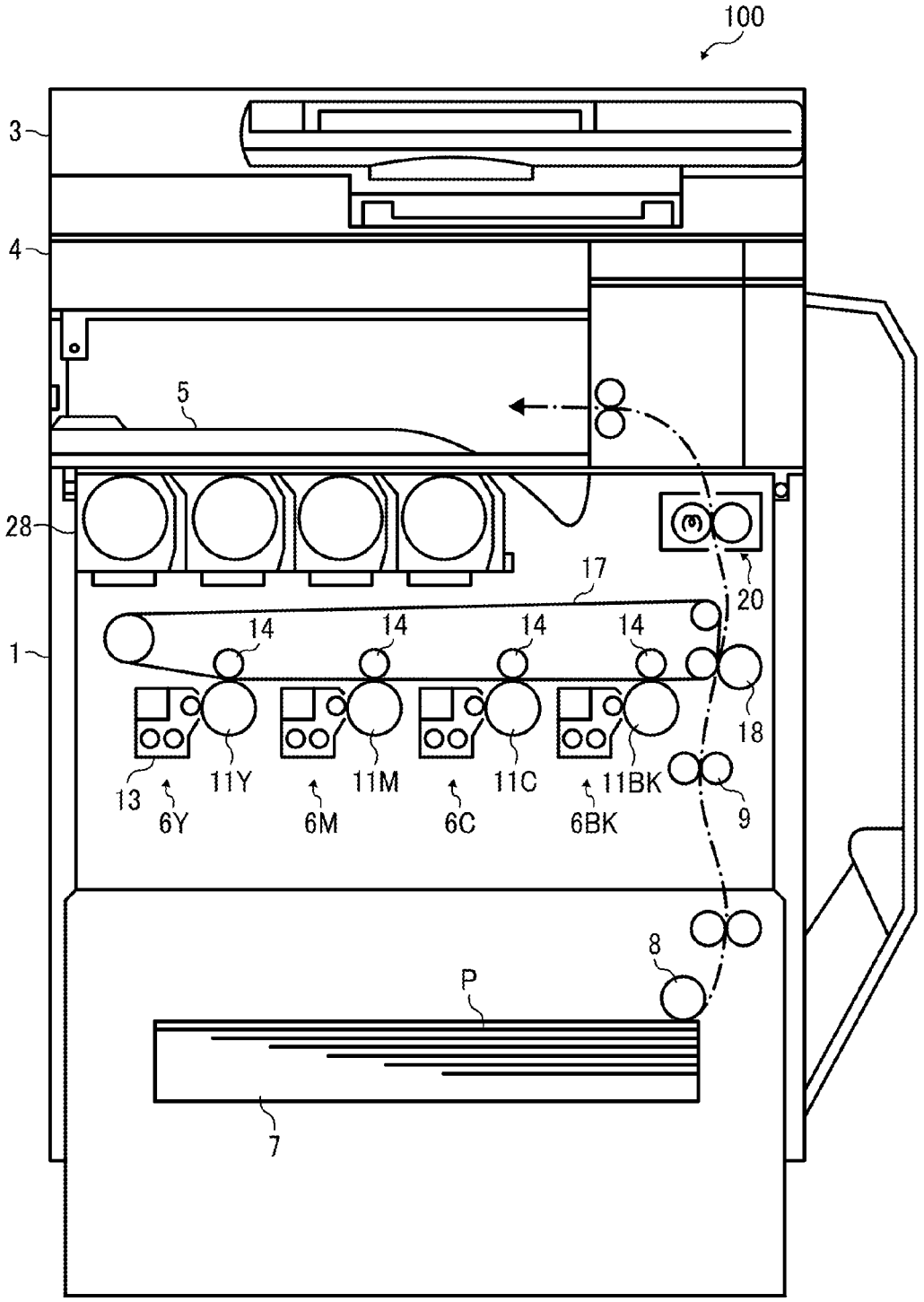
FIG. 1 is a schematic diagram illustrating a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

(First Embodiment)

Referring to FIG. 1, a configuration and operation of an image forming apparatus 100 according to an embodiment is described below.

In FIG. 1, reference numeral 1 represents an apparatus body of the image forming apparatus 100 that in the present embodiment is a tandem-type multicolor copier, 3 represents a document feeder to send an original to a document reading unit 4 that reads image data of the original, 5 represents a discharge tray on which output images are stacked, 7 represents a sheet tray containing sheets P of recording media, 8 represents feed rollers, 9 represents a pair of registration rollers to adjust the timing to transport the sheet P, 11 represents photoreceptor drums serving as image bearers on which yellow, magenta, cyan, and black toner images are formed, respectively, 13 represents development devices to develop electrostatic latent images formed on the respective photoreceptor drums 11, and 14 represents transfer bias rollers or primary-transfer rollers to transfer toner images formed on the respective photoreceptor drums 11 onto an intermediate transfer belt 17.

In each of image forming units 6Y, 6M, 6C, and 6BK, a charging unit 12, the development device 13, and a cleaning unit 15 are provided around the photoreceptor drum 11. The photoreceptor drum 11 and at least one of those components may be housed in a common unit casing, together forming a process cartridge. The four image forming units 6 have a similar configuration.

It is to be noted that, the term "process cartridge" used in this specification means a modular unit including an image bearer and at least one of a charging unit, a development device, and a cleaning unit housed in a common unit casing and can be removably installed together in an apparatus body.

Further, reference numeral 18 represents a secondary-transfer roller to transfer the superimposed toner image from the intermediate transfer belt 17 onto the sheet P, 20 represents a fixing device to fix the toner image on the sheet P, 28 represents toner containers from which respective color toners are supplied to the development devices 13.

Figure 2:
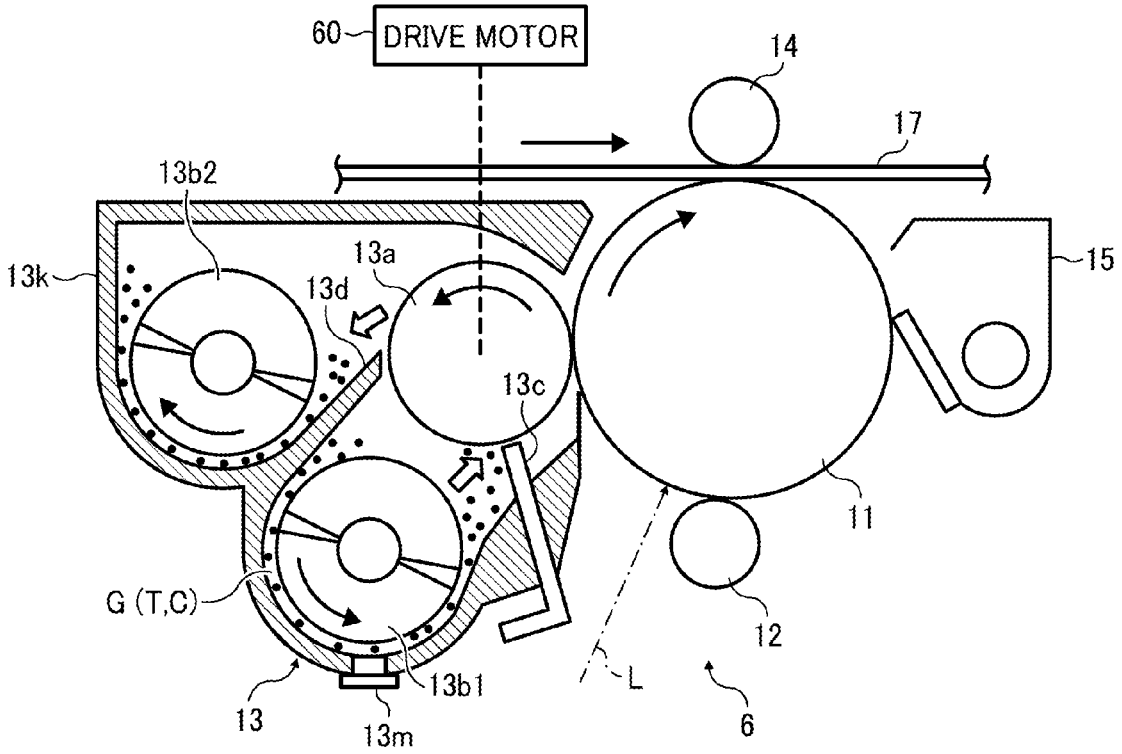
FIG. 2 is a schematic diagram illustrating a configuration of an image forming unit included in the image forming apparatus shown in FIG. 1.

Operations of the image forming apparatus 1 shown in FIG. 1 to form multicolor images are described below. It is to be noted that FIG. 2 is also referred to when image forming process performed on the respective photoreceptor drums 11 are described.

Conveyance rollers provided in the document feeder 3 transport originals set on a document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via mirrors and lenses. The color sensor reads the multicolor image data of the original for each of decomposed colors of red, green, and blue (RGB), and converts the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to an exposure unit (also "writing unit"). The exposure unit directs laser beams L to surfaces of the respective photoreceptors 11 according to image data of respective colors.

Meanwhile, the four photoreceptor drums 11 rotate clockwise in FIG. 1. As shown in FIG. 2, the surface of the photoreceptor drum 11 is charged by the charging unit 12 (e.g., a charging roller) uniformly at a position facing the charging unit 12 (charging process). Thus, the surface of the photoreceptor drum 11 is charged to a predetermined electrical potential. When the surfaces of the photoreceptor drums 11 reach positions to receive the laser beams L, respectively, the exposure unit directs the laser beams L according to the respective color image data, emitted from four light sources, to the respective photoreceptor drums 11, which is referred to as an exposure process.

The four laser beams L pass through different optical paths for yellow, magenta, cyan, and black.

The laser beam L corresponding to the yellow component is directed to the photoreceptor drum 11Y, which is the first from the left in FIG. 1 among the four photoreceptor drums 11. A polygon mirror that rotates at high velocity deflects the laser beam L for yellow in a direction of a rotation axis of the photoreceptor drum 11Y (main scanning direction) so that the leaser beam L scans the surface of the photoreceptor drum 11Y. Thus, an electrostatic latent image for yellow is formed on the photoreceptor drum 11Y charged by the charging unit 12.

Similarly, the laser beam L corresponding to the magenta component is directed to the surface of the photoreceptor drum 11M that is the second from the left in FIG. 1, thus forming an electrostatic latent image for magenta thereon. The laser beam L corresponding to the cyan component is directed to the surface of the photoreceptor drum 11C that is the third from the left in FIG. 1, thus forming an electrostatic latent image for cyan thereon. The laser beam L corresponding to the black component is directed to the surface of the photoreceptor drum 11BK that is the fourth from the left in FIG. 1, thus forming an electrostatic latent image for black thereon.

Then, each photoreceptor drum 11 reaches a position facing the development device 13, and the development device 13 supplies toner of the corresponding color to the photoreceptor drum 11. Thus, the latent images on the respective photoreceptor drums 11 are developed into different single-color toner images in a development process.

Subsequently, the surface of the photoreceptor drum 11 reaches a position facing the intermediate transfer belt 17, serving as the image bearer as well as an intermediate transfer member. The primary-transfer rollers 14 are provided in contact with an inner circumferential surface of the intermediate transfer belt 17 at the positions where the respective photoreceptor drums 11 face the intermediate transfer belt 17. At these positions, the toner images formed on the respective photoreceptor drums 11 are sequentially transferred and superimposed one on another on the intermediate transfer belt 17, forming a multicolor toner image thereon, in a primary transfer process.

After the primary transfer process, the surface of each photoreceptor drum 11 reaches a position facing the cleaning unit 15, which collects any toner remaining on the photoreceptor drum 11, which is hereinafter referred to as "untransferred toner" (cleaning process).

Additionally, the surface of each photoreceptor drum 11 passes through a discharge device, and thus a sequence of image forming processes performed on each photoreceptor drum 11 are completed.

Meanwhile, the surface of the intermediate transfer belt 17 carrying the superimposed toner image moves counterclockwise and reaches the position facing the secondary-transfer roller 18. The secondary-transfer roller 18 transfers the multicolor toner image from the intermediate transfer belt 17 onto the sheet P (secondary-transfer process).

Further, the surface of the intermediate transfer belt 17 reaches a position facing a belt cleaning unit. The belt cleaning unit collects any untransferred toner remaining on the intermediate transfer belt 17, and thus a sequence of transfer processes performed on the intermediate transfer belt 17 is completed.

The sheet P is transported from one of the sheet trays 7 via the registration rollers 9, and the like, to the secondary-transfer nip formed between the intermediate transfer belt 17 and the secondary-transfer bias roller 18.

More specifically, the feed roller 8 sends out the sheet P from the sheet tray 7, and the sheet P is then guided by a sheet guide to the registration rollers 9. The registration rollers 9 forward the sheet P to the secondary transfer nip, timed to coincide with the arrival of the multicolor toner image formed on the intermediate transfer belt 17.

Then, the sheet P carrying the multicolor image is transported to the fixing device 20. The fixing device 20 includes a fixing roller and a pressure roller pressing against each other, forming a nip therebetween, in which the multicolor image is fixed on the sheet P.

After the fixing process, a pair of discharge rollers discharges the sheet P as an output image to the discharge tray 5, provided outside the apparatus body 1. Thus, a sequence of image forming processes is completed.

Next, the image forming units 6 are described in further detail below with reference to FIGS. 2 through 5.

Figure 3:
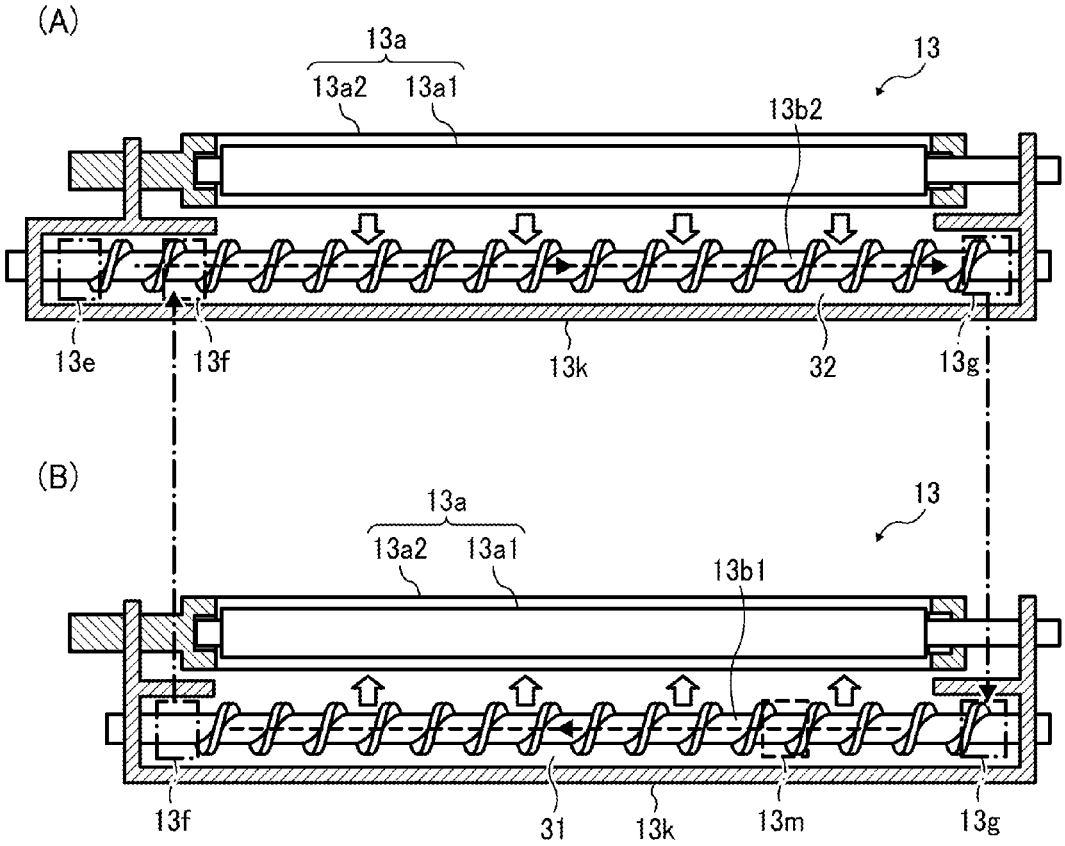
FIG. 3 schematically illustrates horizontal cross sections of a development device according to an embodiment, as viewed in the longitudinal direction, and (A) and (B) respectively illustrate an upper portion and a lower portion of the development device.
Figure 4:
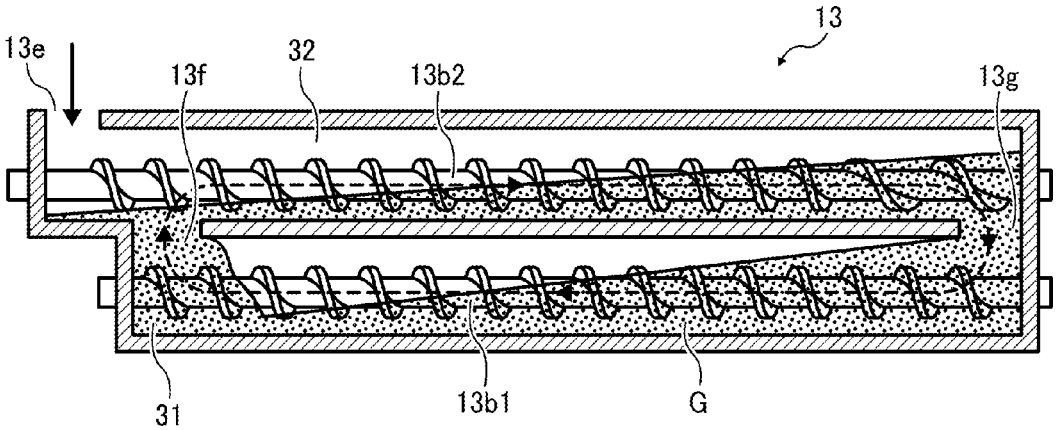
FIG. 4 illustrates a vertical cross section of the development device shown in FIG. 3, viewed in the longitudinal direction.

FIG. 2 is a schematic diagram illustrating a configuration of the image forming unit 6. FIG. 3 schematically illustrates horizontal cross sections of the development device 13, and (A) and (B) respectively illustrate an upper portion (where a second conveyance screw 13*b*2 is provided) and a lower portion (where a first conveyance screw 13*b*1 is provided) of the development device 13 in a longitudinal direction of the development device 13. FIG. 4 illustrates a vertical cross section of the development device 13 in the longitudinal direction.

As shown in FIG. 2, each image forming unit 6 includes the photoreceptor drum 11, the charging unit 12, the development device 13, the cleaning unit 15, and the like.

The photoreceptor drum 11 in the present embodiment is a negatively-charged organic photoreceptor having an external diameter of about 30 mm and is rotated counterclockwise in FIG. 2 by a driving unit.

The charging unit 12 is an elastic charging roller and can be formed by covering a metal core with an elastic layer of moderate resistivity, such as foamed urethane layer, that includes carbon black as electroconductive particles, sulfuration agent, foaming agent, and the like. The material of the elastic layer of moderate resistivity include, but not limited to, rubber such as urethane, ethylene-propylene-diene (EPDM), acrylonitrile butadiene rubber (NBR), silicone rubber, and isoprene rubber to which electroconductive material such as carbon black or metal oxide is added to adjust the resistivity. Alternatively, foamed rubber including these materials may be used.

The cleaning unit 15 includes a cleaning brush or cleaning blade that slidingly contacts the surface of the photoreceptor drum 11 and removes any toner adhering to the photoreceptor drum 11 mechanically.

The development device 13 includes a development roller 13*a*, serving as a developer bearer, disposed close to the photoreceptor drum 11. In the portion where the development roller 13*a* faces the photoreceptor drum 11, a magnetic brush formed on the development roller 13*a* contacts the surface of the photoreceptor drum 11, thus forming a development range or development nip. The development device 13 contains two-component developer G including toner particles T (also "toner T") and carrier particles C (also "carrier C"). In the present embodiment, for example, concentration of toner in developer G is 7 percent by weight, and a predetermined amount of developer G is contained in the development device 13. The development device 13 develops the latent image formed on the photoreceptor drum 11 with the developer G into a toner image. The configuration and operation of the development device 13 are described in further detail later.

Referring to FIG. 1, the toner container 28 contains toner T to be supplied to the development device 13. For example, a magnetic detector 13*m* serving as a toner concentration detector is provided to the development device 13, and according to toner concentration (the ratio of toner in developer G) detected by the magnetic detector 13*m*, toner T is supplied from the toner container 28 through a toner conveyance tube and via a supply inlet 13*e* (shown in FIG. 3) to the development device 13 as required.

It is to be noted that the data according to which toner T is supplied is not limited to direct toner concentration data thus detected. Alternatively, for example, toner T may be supplied according to indirect toner concentration data such as image density calculated from the reflectance of the toner image formed on the photoreceptor drum 11 or the intermediate transfer belt 17. Yet alternatively, toner T may be supplied according to a combination of such data.

The development device 13 is described in further detail below.

Referring to FIGS. 2 to 5, the development device 13 includes the development roller 13*a* serving as a developer bearer, first and second conveyance screws (screw augers) 13*b*1 and 13*b*2 serving as developer conveyance members, a doctor blade 13*c* serving as a developer regulator, and a partition 13*d*.

The outer diameter of the development roller 13*a* is about 18 mm, for example. The development roller 13*a* includes a cylindrical sleeve 13*a*2 formed of a nonmagnetic material such as aluminum, brass, stainless steel, or conductive resin and is rotated counterclockwise in FIG. 2 at a velocity of about 420 revolutions per minute (rpm) during standard-speed operation (a standard velocity) by a drive motor 60.

Figure 5:
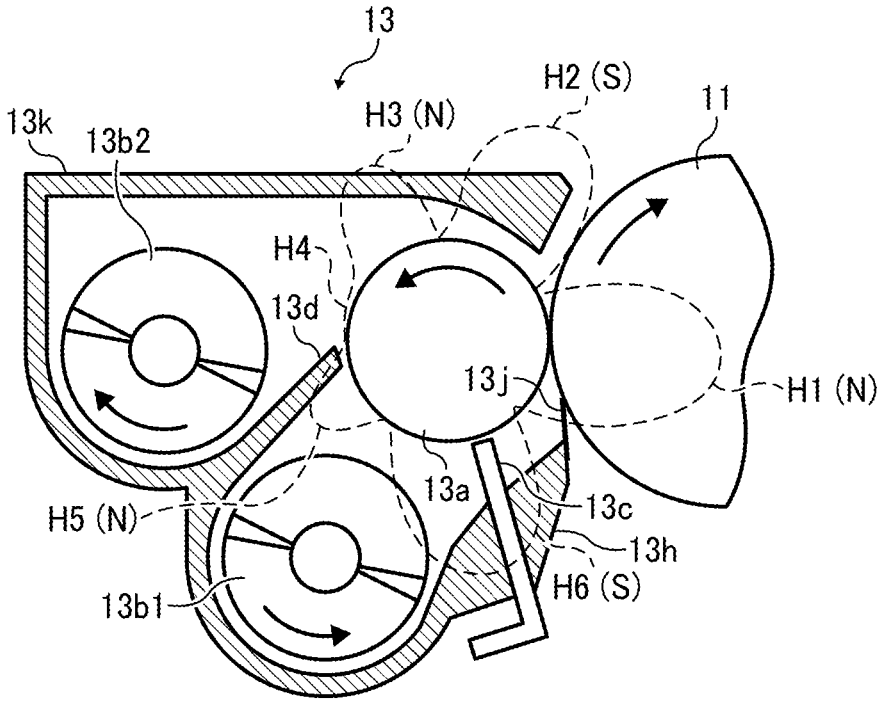
FIG. 5 is an end-on axial view illustrating a configuration of the development device shown in FIG. 3.

Referring to FIGS. 3 and 5, a magnet 13*a*1 is provided inside the sleeve 13*a*2 and its position is fixed relative to the sleeve 13*a*2. The magnet 13*a*1 generates the multiple magnetic poles H1 through H6 around a circumferential surface of the sleeve 13*a*2. While the development roller 13*a* rotates in the direction indicated by the arrow shown in FIG. 2, the developer G carried on the circumferential surface thereof is transported to a position facing the doctor blade 13*c* (hereinafter "doctor gap"), where the amount of the developer G is adjusted, and is further transported to the development range facing the photoreceptor drum 11. Then, the toner in the developer G adheres to the latent image formed on the photoreceptor drum 11 due to the effect of the magnetic field generated in the development area.

FIG. 5 illustrates a cross section of the development device 13 perpendicular to an axis of rotation of the development roller 13*a*, together with a distribution of magnetic force exerted by magnetic poles H1 through H6 on the development roller 13*a*.

Referring to FIG. 5, the magnetic poles H1 through H6 of the magnet 13*a*1 generates distribution of the lines of magnetic around the sleeve 13*a*2 as shown. The magnetic pole (main pole) H1 is disposed facing the photoreceptor drum 11. The magnetic pole (conveyance pole) H2 is disposed downstream from the main pole H1 in a direction of rotation of the development roller 13*a* or the sleeve 13*a*2 and partly overlaps an inner wall of a second conveyance channel 32. The magnetic pole (pre-release pole) H3 is disposed above the development roller 13*a* and downstream from the conveyance pole H2 in the direction of rotation of the development roller 13*a*. The magnetic pole (release pole) H4 is positioned between the magnetic pole H3 and H5 and above an end portion of the partition 13*d*. The magnetic pole H5 is positioned above a first conveyance channel 31, and the magnetic pole (attraction pole) H6 extends from a position facing the first conveyance screw 13*b*1 to a position adjacent to the doctor blade 13*c*. The attraction pole H6 can serve also as a developer regulation pole.

Initially, the attraction pole H6 acts on the magnetic carrier particles in the developer G, and thus the developer G contained in the first conveyance channel 31 is carried on the development roller 13*a*. Then, the doctor blade 13*c* scrapes off the developer G partly from the circumferential surface of the development roller 13*a* to adjust the amount of the developer G carried thereon, and the scraped developer G is returned to the first conveyance channel 31.

The developer particles G that have passed through the doctor gap between the doctor blade 13*c* and the circumferential surface of the development roller 13*a* stand on end on the development roller 13*a* due to the magnetic force exerted by the main pole H1, forming a magnetic brush in the development range, and slidingly contact the surface of the photoreceptor drum 11. Thus, the toner T in the developer G carried on the development roller 13*a* adheres to the latent image formed on the photoreceptor drum 11. The developer G that has passed through the development range is kept on the development roller 13*a* by the magnetic force exerted by the magnetic poles H2 and H3, and is transported to the position corresponding to the magnetic pole (release pole) H4.

Then, at a position corresponding to the release pole H4, magnetic repulsion (acting in the direction away from the development roller 13*a*) acts on the carrier particles, and thus the developer G used in the development process leaves the development roller 13*a*. Then, the developer G falls into the second conveyance channel 32 and transported downstream by the second conveyance screw 13*b*2 therein.

It is to be noted that, in FIG. 5, an angle from a segment connecting the center of rotation of the development roller 13*a* and the center of rotation of the photoreceptor drum 11 counterclockwise to a center position in an area where magnetic force of the magnetic pole is half the peak is referred to as "a half-value center angle. For example, in the configuration shown in FIG. 5, the half-value center angle of the magnetic pole H1 is −5°, that of the magnetic pole H2 is 58°, that of the magnetic pole H3 is 120°, that of the magnetic pole H5 is 212°, and that of the magnetic pole H6 is 280°. Additionally, the peak magnetic forces of the magnetic poles H1, H2, H3, H5, and H6 are, for example, 100 mT, 85 mT, 52 mT, 35 mT, and 78 mT, respectively.

The magnetic poles H1 through H6 are generated by five magnetic poles magnetized to the magnet 13*a*1, and each of the five magnetic poles is either south (S) pole or north (N) pole as shown in FIG. 5. In other words, among the six magnetic poles H1 through H6, the magnetic pole H4 is not directly generated by the magnetic pole magnetized to the magnet 13*a*1 but is generated by two magnetic poles having an identical polarity (magnetic poles H3 and H5 whose polarity is N in the configuration shown in FIG. 5), between which the magnetic pole H4 is interposed.

The doctor blade 13*c* serving as the developer regulator is a nonmagnetic planer member disposed beneath the development roller 13*a*. The doctor blade 13*c* may be partly constituted of a magnetic material. In FIG. 2, the development roller 13*a* rotates counterclockwise, and the photoreceptor drum 11 rotates clockwise.

With this configuration, the development roller 13*a* can rotate in the forward direction relative to the photoreceptor drum 11 at the development gap in configurations in which the photoreceptor drums 11 are disposed beneath the intermediate transfer belt 17 to reduce the length of the sheet conveyance path and the horizontal size of the apparatus body 1. Accordingly, a sufficient development time in the development gap can be secured, increasing developing ability, compared with a configuration in which the doctor blade 13*c* is above the development roller 13*a* and the development roller 13*a* rotates in the counter direction relative to the photoreceptor drum 11.

The first conveyance screw 13*b*1 and the second conveyance screw 13*b*2 agitate and mix the developer G contained in the development device 13 while transporting the developer G horizontally in the longitudinal direction or the axial direction, perpendicular to the surface of the paper on which FIG. 2 is drawn.

The first conveyance screw 13*b*1 is disposed facing the development roller 13*a* and supplies the developer G to the development roller 13*a* as indicated by hollow arrows shown in FIG. 3 at the position corresponding to the attraction pole H6 shown in FIG. 5 while transporting the developer G in the first conveyance channel 31 to the left in (B) of FIG. 3 as indicated by a broken arrow shown therein. The first conveyance screw 13*b*1 rotates counterclockwise in FIG. 2.

The second conveyance screw 13*b*2 is disposed above the first conveyance screw 13*b*1 and faces the development roller 13*a*. The second conveyance screw 13*b*2 transports the developer G that has left the development roller 13*a* (developer forced to leave the development roller 13*a* in the direction indicated by hollow arrow after image development) to the right in the second conveyance channel 32 as indicated by a broken arrow shown in (A) of FIG. 3. It is to be noted that, in the present embodiment, the second conveyance screw 13*b*2 is configured to rotate clockwise in FIG. 2, which is the opposite the direction of rotation of the development roller 13*a*.

The developer G transported from the downstream portion of the first conveyance channel 31 through a first communication opening 13*f* is transported by the second conveyance screw 13*b*2 downstream in the second conveyance channel 32, and is further transported from the second conveyance channel 32 to the upstream portion of the first conveyance channel 31 through a second communication opening 13*g* as indicated by a broken arrow shown in FIG. 3.

The first and second conveyance screws 13*b*1 and 13*b*2 are disposed so that their axes of rotation are substantially horizontal similarly to the development roller 13*a* and the photoreceptor drum 11. For example, each of the first and second conveyance screws 13*b*1 and 13*b*2 is formed of a screw shaft having a diameter of about 6 mm to 10 mm and a bladed screw spiral having an external diameter of about 20 mm and winding around the screw shaft with a screw pitch of about 40 mm (single or double thread). The rotational frequency of the first and second conveyance screws 13*b*1 and 13*b*2 for standard operation is about 700 rpm (standard velocity), for example.

A gear train is formed between the shafts of the first and second conveyance screws 13*b*1 and 13*b*2 and the development roller 13*a* (sleeve 13*a*2) although not shown in the drawings. A driving force input to the development roller 13*a* from the drive motor 60 is transmitted through the gear train to the two conveyance screws 13*b*1 and 13*b*2, thus rotating the two conveyance screws 13*b*1 and 13*b*2. In the present embodiment, the gear train is configured to set the frequency of rotation of the two conveyance screws 13*b*1 and 13*b*2 to five-thirds of that of the development roller 13*a*.

It is to be noted that the drive motor 60 is a variable-frequency motor and can vary the drive velocity (rotational frequency) of the development roller 13*a* and the first and second conveyance screws 13*b*1 and 13*b*2, which is described in further detail later.

Referring to FIGS. 3 and 4, the downstream end portion of the second conveyance channel 32 in which the second conveyance screw 13*b*2 transports developer communicates with the upstream end portion of the first conveyance channel 31 through a second communication port 13*g*. In the downstream end portion of the second conveyance channel 32, the developer G falls under its own weight through the second communication port 13*g* to the upstream end portion of the first conveyance channel 31.

The downstream end portion of the first conveyance channel 31 in which the first conveyance screw 13*b*1 transports developer communicates with the upstream end portion of the second conveyance channel 32 through a first communication port 13*f*. In the first conveyance channel 31, the developer G that is not supplied to the development roller 13*a* accumulates adjacent to the first communication port 13*f* and then transported through the first communication port 13*f* to the upstream end portion of the second conveyance channel 32.

It is to be noted that a paddle or screw winding in the opposite direction may be provided to a downstream portion of the first conveyance channel 31 (at a position facing the first communication opening 13*f*) to facilitate conveyance of developer through the first communication opening 13*f* (upward movement from the first conveyance channel 31 to the second conveyance channel 32 against the gravity).

With this configuration, a circulation channel through which the developer G is circulated in the longitudinal direction by the first and second conveyance screws 13*b*1 and 13*b*2 in the development device 13 is formed. That is, when the development device 13 is activated, the developer G contained therein flows in the developer circulation direction indicated by the broken arrows shown in FIGS. 3 and 4. Separating the first conveyance channel (supply channel) 31 from the second conveyance channel (collecting channel) 32 can reduce unevenness in the density of toner image on the photoreceptor drum 11.

It is to be noted that the magnetic detector 13*m* (i.e., toner concentration detector) to detect the concentration of toner in the developer circulated in the device is disposed in or on the outer face of the second conveyance channel 32. Based on the toner concentration detected by the magnetic detector 13*m*, fresh toner T is supplied from the toner container 28 to the development device 13 through the supply inlet 13*e* disposed adjacent to the first communication opening 13*f* in the collecting channel 32.

Additionally, referring to FIGS. 3 and 4, the supply inlet 13*e* is formed in an upper portion on the upstream side of the collecting channel 32, away from the development range, that is, disposed outside the area occupied by the development roller 13*a* in the longitudinal direction. Disposing the supply inlet 13*e* close to the first communication opening 13*f* is advantageous in that the used developer that has left the development roller 13*a* can fall on the supplied toner whose specific gravity is smaller and the mixture is transported in the collecting channel 32 for a relatively long time. Accordingly, the supplied toner can be dispersed better in the developer.

It is to be noted that the position of the supply inlet 13*e* is not necessarily inside the collecting channel 32 but can be in an upper portion in the upstream portion of the supply channel 31, for example. It is to be noted that the position of the magnetic detector 13*m* is not necessarily beneath the supply channel 31 but can be in beneath the downstream portion of the collecting channel 32, for example.

Additionally, referring to FIG. 4, the surface of developer G in the first conveyance channel 31 gradually decreases downstream in the developer circulation direction except the adjacent area of the first communication opening 13*f* because the first conveyance screw 13*b*1 supplies the developer G to the development roller 13*a* while transporting the developer G longitudinally. By contrast, the surface of developer G in the second conveyance channel 32 increases downstream because the second conveyance screw 13*b*2 collects the developer that has left the development roller 13*a* while transporting the developer longitudinally.

As shown in FIG. 5, in the development device 13 according to the present embodiment, the partition 13*d* (i.e., an inner wall of the development device 13 serving as a planar separator) is disposed facing the development roller 13*a* to separate the first conveyance channel (supply channel) 31 from the second conveyance channel (collecting channel) 32. In other words, the partition 13*d* is provided between the first conveyance channel 31 and the second conveyance channel 32 to inhibit the developer that has left the development roller 13*a* from being carried on the development roller 13*a*.

Specifically, the partition 13*d* projects toward the development roller 13*a* from the development casing 13*k*. The partition 13*d* is integrated or continuous with the development casing 13*k* (indicated by hatching in FIG. 2). For example, a clearance of less than 2 mm (preferably within a range of 0.1 mm to 0.5 mm) is provided between the development roller 13*a* and a face of the partition 13*d* facing the development roller 13*a*. In the present embodiment, the clearance is about 0.3 mm, for example.

Forming the partition 13*d* with a nonmagnetic material is advantageous in that the magnetic carrier particles partition 13*d* does not magnetically attract carrier particles, thus reducing the inconveniences of blocking flow of developer inside the second conveyance channel 32 or promoting movement of developer toward the first conveyance channel 31.

The development casing 13*k* contains the development roller 13*a* such that the development roller 13*a* is exposed at the position facing the photoreceptor drum 11 (development range). The development casing 13*k* also contains the first and second conveyance screws 13*b*1 and 13*b*2. The development casing 13*k* may be constituted of multiple separate components (e.g., upper and lower cases).

Additionally, in the present embodiment, a size of a clearance (casing gap) between an upper portion of the development casing 13*k* (downstream from the development range) and the development roller 13*a* is within a range of from about 1.2 mm to 2.0 mm. With this configuration, developer particles standing on end on the development roller 13*a* (after image development) are transported while sliding on the development casing 13*k* to seal the casing gap. Accordingly, a sucking-in airflow flowing into the development device 13 can be generated, inhibiting developer particles from scattering outside the development device 13.

Referring to FIG. 5, a retainer 13*h* that also serves as a cover for covering the doctor blade 13*c* from outside is provided at a position facing the doctor blade 13*c* (upstream from the development range). Additionally, a flexible entrance seal 13*j* is bonded to the retainer 13*h*. Specifically, the entrance seal 13*j* is disposed facing the photoreceptor drum 11 and can be formed of polyurethane resin or the like, for example. The entrance seal 13*j* contacts the photoreceptor drum 11 with a relatively small pressure and is designed to alleviate scattering of developer (toner) from the development device 13 upstream from the development range.

Next, developer usable in the present embodiment is described below.

The toner T (a component of developer G) used in the present embodiment is polymerized toner and includes binder resin. Examples of the binder resin include styrene resin (single polymer or copolymer that includes styrene or styrene substitution product) such as styrene-acrylonitrile-acrylate copolymer, polyester resin, epoxy resin, and compounds thereof. Such polymerized toners can be produced using bulk polymerization, solution polymerization, emulsion polymerization, or suspension polymerization. It is to be noted that pulverized toner can be used instead of polymerized toner.

As an external additive, inorganic fine particles are preferable. For example, 1.0 weight percent of silica and 0.5 weight percent of titanium oxide may be used. As a release agent, oxide of rice wax, low-molecular polypropylene wax, or carnauba wax may be used. Additionally, a charge controlling agent may be included.

The toner T used in the present embodiment is small-diameter toner having a volume average particle diameter of about 5.8 μM. In the toner T, percentage by number of particles having a diameter of 5 μm or smaller is 60% to 80%.

The carrier C in the developer G used in the present embodiment is small-diameter carrier having a weight average particle diameter of within a range from 20 μm to 60 μm. For example, weight average particle diameter of carrier C is 35 μm in the present embodiment. Specifically, the carrier C includes a ferrite particle as a core and, and the core particle is coated with 0.5 μm of methylmethacrylate (MMA) resin to have the above-described particle diameter, for example. Alternatively, coated carrier having a magnetite core may be used.

Use of small-diameter carrier can enhance density uniformity of solid images or halftone image quality. Additionally, small-diameter carrier can enhance coating rate of toner for coating carrier and is good with small-diameter toner suitable for high image quality.

A distinctive feature of the development device 13 according to the present embodiment is described below.

The development device 13 according to the present embodiment can perform image development at multiple different speeds. That is, the development device 13 can operate in multiple different speed modes, namely, a lower speed mode (hereinafter "low-speed mode") in which each of the development roller 13*a* (i.e., the developer bearer) and the first and second conveyance screws 13*b*1 and 13*b*2 (i.e., the developer conveyance members) is driven at a velocity lower than the standard velocity for a standard mode or a higher speed mode (hereinafter "high-speed mode").

Specifically, as described above, the development device 13 is driven by the variable-frequency type drive motor 60 that can vary the rotational frequency of the development device 13, namely, the development roller 13*a* and the first and second conveyance screws 13*b*1 and 13*b*2. When the high-speed mode is selected, the drive motor 60 drives the development roller 13*a* to rotate at a velocity of, for example, 420 rpm and the first and second conveyance screws 13*b*1 and 13*b*2 to rotate at a velocity of, for example, 700 rpm. By contrast, when the low-speed mode is selected, the drive motor 60 drives the development roller 13*a* to rotate at a velocity of 120 rpm and the first and second conveyance screws 13*b*1 and 13*b*2 to rotate at a velocity of 200 rpm, for example.

The low-speed mode can be selected by users via a control panel 201 (shown in FIG. 12) or selected automatically by a controller 200 provided to the apparatus body 1 for, for example, forming images on thicker sheets (i.e., heavy paper) such as post cards, or forming higher quality images. When the low-speed mode is selected, in addition to driving of the development device 13 by the drive motor 60, sheet conveyance speed and image formation speed (i.e., process linear velocity) driven by a variable-speed drive unit 204 provided in the apparatus body 1 are slowed down.

In development devices in which multiple developer conveyance members are disposed vertically, facing the developer bearer, when high-speed image development, in which the developer bearer and the multiple developer conveyance members are driven at higher velocities, proceeds from low-speed image development, it is possible that the amount of developer in the first conveyance channel is insufficient for a while, and the amount of developer carried on the developer bearer becomes insufficient. As a result, image density in output images becomes uneven corresponding to the screw pitch of the developer conveyance members.

In view of the foregoing, an aim of the present embodiment is to provide a development device, a process cartridge, and an image forming apparatus capable of inhibiting image failure such as the above-described image density unevenness caused under the above-described conditions.

Specifically, in the present embodiment, after low-speed image development is completed, at least the first and second conveyance screws 13*b*1 and 13*b*2 can be driven idle (hereinafter "idle driving" or "developer amount adjustment") at a velocity higher than that in the low-speed mode for a predetermined duration of time. For example, the duration of idle driving is about 1.5 seconds to 2.5 seconds and corresponds to the period of time for feeding three to four sheets in the present embodiment.

When the development device 13 processes two jobs (i.e., preceding and subsequent jobs) consecutively, there are four different cases, namely, 1) a job in low-speed mode (i.e., a low-speed job) proceeds sequentially from a job in high-speed mode (i.e., a standard-speed job), 2) a standard-speed job is executed after a low-speed job, 3) another standard-speed job is executed subsequent to a standard-speed job, and 4) a low-speed job is executed subsequent to a low-speed job.

The idle driving is executed after the low-speed job as the preceding operation is completed if predetermined criteria are satisfied in the second and fourth cases.

More specifically, the idle driving means driving the developer bearer (i.e., development roller 13*a*) and the multiple developer conveyance members (i.e., first and second conveyance screws 13*b*1 and 13*b*2) for the predetermined period at the respective velocities (may be equal to the standard velocities) higher than those for low-speed mode. In other words, in the idle driving in the present embodiment, the development device 13 (the development roller 13*a* and the first and second conveyance screws 13*b*1 and 13*b*2) is driven, without performing image development, at a velocity higher than that in the low-speed mode, and the velocity for idle driving is equal to the standard velocity.

With the above-described control, in the case in which standard-speed image development is executed after low-speed image development, temporary shortage of developer in the first conveyance channel 31, in which the first conveyance screw 13*b*1 is provided, can be alleviated. Although such temporary shortage of developer causes shortage of developer carried on the development roller 13*a* and makes image density in output images uneven (corresponding to the screw pitch of the first conveyance screw 13*b*1), such image failure can be inhibited with the above-described control.

The occurrence of the image density unevenness is described below.

When standard-speed image development is to be executed after low-speed image development is executed for a certain period of time, immediately after the operation mode is switched to the standard mode, the balance of the amount of developer (hereinafter "developer amount balance") in the first conveyance channel 31 and the second conveyance channel 32 tends to significantly deviate from the proper balance. When the operation mode is switched to the higher speed mode, the rotational frequency of the first and second conveyance screws 13*b*1 and 13*b*2 is increased, thus increasing the circulation speed of developer. However, the amount of developer supplied by the first conveyance screw 13*b*1 to the development roller 13*a* rotating at the increased velocity is insufficient initially. Thus, the developer amount balance is disturbed.

Shortage of developer on the development roller 13*a* can be resolved in time since the developer amount balance in the first and second conveyance channels 31 and 32 recovers as the development device 13 operates in the standard mode. However, image density unevenness is caused while developer amount balance is improper. Although warm-up operation of the development device 13 may be executed before the subsequent standard-speed image development to attain a proper developer amount balance, it increases the warm-up time for the subsequent image development, thus delaying the first print output.

By contrast, in the present embodiment, the idle driving is executed under the predetermined conditions immediately after the low-speed job is completed, thereby securing the proper developer amount balance in the development device 13 for the standard mode. Accordingly, even when the standard-speed job is executed subsequent to the low-speed job, occurrence of image density unevenness can be alleviated. Thus, the idle driving is hereinafter also referred to as "developer amount balance adjustment".

It is to be noted that, at the end of the low-speed job, it is not known whether another low-speed job is performed consecutively, or the operation mode is switched to the standard mode after the low-speed job. Therefore, the above-described control is executed, under the predetermined conditions, after a low-speed job is completed in the present embodiment. It means that the amount of developer in the first conveyance channel 31 is relatively large if the subsequent job is executed in the low-speed mode. Even in such states, the upper limit of the amount of developer carried on the development roller 13*a* can be almost determined by the attraction pole H6, and moreover the excess developer can be removed by the doctor blade 13*c*. Thus, it is tolerable. However, it is desirable that the capacity of the first conveyance channel 31 be sufficient for preventing developer from leaking outside even after the idle driving is executed.

It is to be noted that the idle driving can be omitted when the concentration of toner detected by the magnetic detector 13*m* is not lower then the threshold even after the low-speed job. When the concentration of toner in the developer contained in the development device 13 is sufficient, possibility of occurrence of image density unevenness is lower even if standard-speed image development proceeds from low-speed image development without the idle driving, compared with a state in which the toner concentration is low. For example, in the case of low-speed image development of a number of images having an extremely low image area ratio, the concentration of toner can be sufficiently high at the end of the image development. Additionally, in the present embodiment, the threshold of the concentration of toner can be about 7% for the above-described control.

Further, the idle driving may be omitted when the duration of low-speed image development is lower than the predetermined threshold. If the duration of low-speed image development is short, the developer amount balance does not significantly deviate from that during standard-speed image development. Accordingly, the possibility of occurrence of image density unevenness is lower even when standard-speed image development proceeds sequentially from low-speed image development without idle driving. For example, the duration of low-speed image development can be detected by a timer 202 shown in FIG. 12 or recognized from the number of sheets P on which images are formed. In the present embodiment, the threshold of the duration of low-speed image development may be duration of time for outputting ten sheets P or so in the above-described control.

Figure 6:
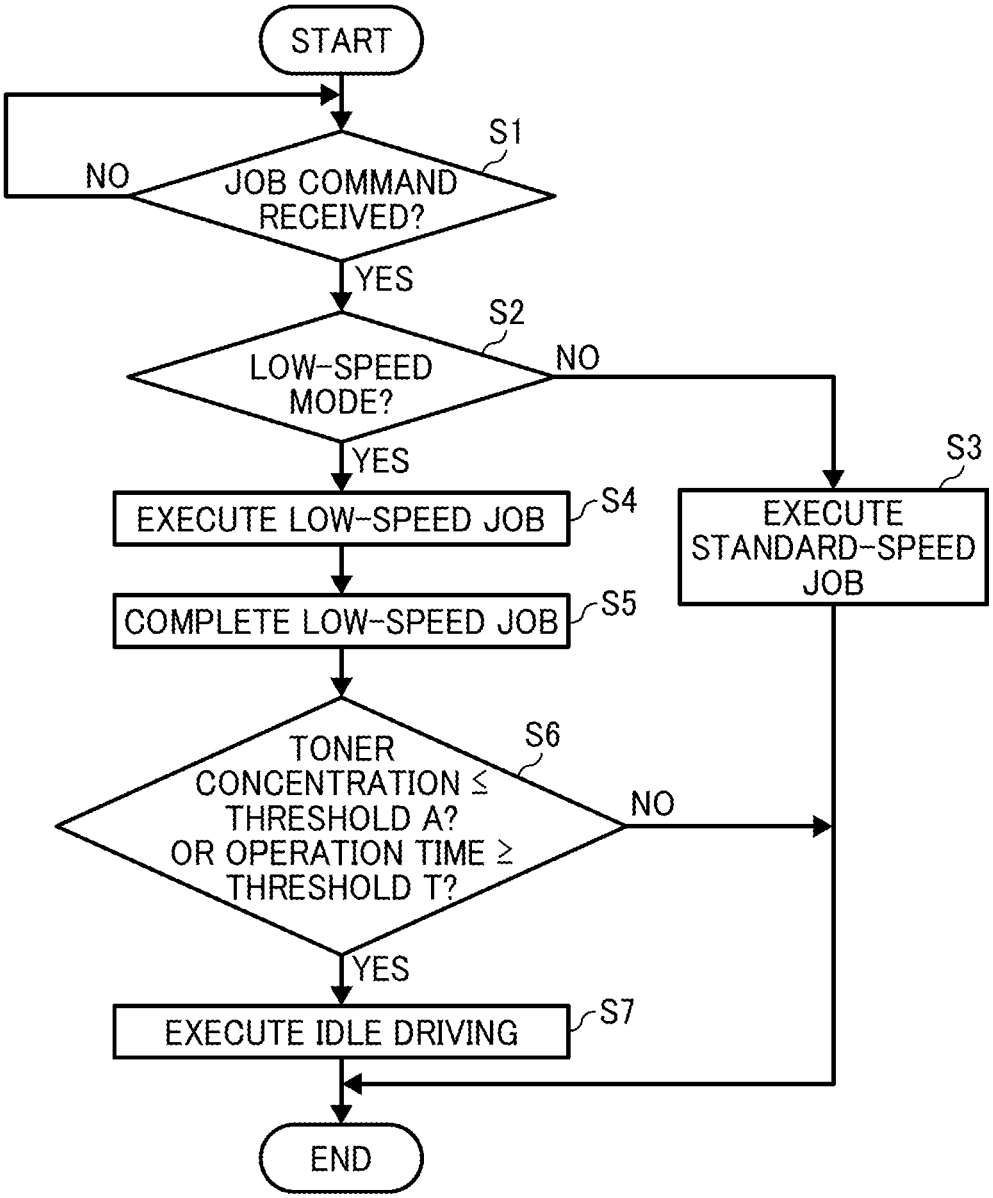
FIG. 6 is a flowchart of operational sequence according to an embodiment, when low-speed image formation is performed.

FIG. 6 is a flowchart of the above-described control.

As shown in FIG. 6, when a job command (i.e., a preceding job) is received at S1, the controller 200 determines whether that job is in the low-speed mode or the standard mode at S2. When the preceding job is not in the low-speed mode but the standard mode, that is, a standard-speed job, (No at S2), at S3 the standard-speed job is executed consecutively after a predetermined warm-up operation is completed. Thus, the process ends.

By contrast, when the mode is the low-speed mode (Yes at S2), at S4 the preceding job is executed in the low-speed mode (i.e., a low-speed job) after the predetermined warm-up operation. After the low-speed job is completed at S5, at S6 the controller 200 determines whether the toner concentration detected by the magnetic detector 13*m* (at the end of the preceding job or immediately before the subsequent job) is equal to or lower than a predetermined threshold A. When the detected toner concentration is greater than the predetermined threshold A (No at S6), it is deemed that image density unevenness is not caused. Accordingly, the process ends without performing the idle driving.

When the detected toner concentration is equal to or lower than the predetermined threshold A (Yes at S6), at S7 idle driving is executed for the predetermined period to eliminate the risk of image density unevenness. Then, the process ends.

It is to be noted that, alternatively, at S6 the controller 200 may determine whether the run time in the low-speed mode equals to or greater than a predetermined threshold T, and the subsequent procedure can be performed depending on the determination result. Yet alternatively, determination may be made based on both of the run time in the low-speed mode and toner concentration, and the subsequent steps may be changed according to the results of those determinations.

Effects attained by the present embodiments were experimentally confirmed as follows.

Table 1 shows configurations of the present embodiment and comparative examples 1 through 5 and confirmation results of effects attained by the present embodiments.

TABLE 1

| | TONER CONCEN-TRATION | WEIGHT OF TONER (g) | RUN TIME OF IDLE DRIVING (S) | IMAGE DENSITY UNEVEN-NESS |
|---|---|---|---|---|
| COMPARATIVE EXAMPLE 1 | 7 | 400 | 0 | GOOD |
| COMPARATIVE EXAMPLE 2 | 6 | 395 | 0 | GOOD |
| COMPARATIVE EXAMPLE 3 | 5 | 391 | 0 | ACCEPT-ABLE |
| COMPARATIVE EXAMPLE 5 | 4 | 387 | 0 | BAD |
| COMPARATIVE EXAMPLE 1 | 4 | 387 | 1.0 | BAD |
| EMBODIMENT 1 | 4 | 387 | 1.5 | GOOD |

In each of the present embodiment and the comparative examples 1 through 5, the standard-speed job was executed subsequent to the low-speed job, and the output images were visually checked for image failure, more particularly, image density unevenness resulting from improper developer amount balance. The concentration of toner after completion of the low-speed job, the amount of developer in the development device 13, and run time of idle driving in the respective configurations were as shown in Table 1. Regarding the evaluation of "image density unevenness" shown in Table 1, "good" means that image density unevenness is not observed, "acceptable" means that the image density is slightly uneven but acceptable, and "bad" means the image density is unacceptably uneven.

As shown in Table 1, the effects of the present embodiment can be confirmed.

As described above, in the present embodiment, when the low-speed mode is selected, in addition to driving of the development device 13 by the drive motor 60, sheet conveyance speed and image formation speed (i.e., process linear velocity) driven by the variable-speed drive unit 204 constructed of a single or multiple motors provided in the apparatus body 1 are slowed down. That is, during operation in the low-speed mode, the drive unit 204 drives the photoreceptor drum 11 and other components (hereinafter "driven members") at a velocity lower than the standard velocity. The driven members here are not the photoreceptor drum 11 nor the development device 13 but other members, such as the charging unit 12 in the image forming unit, conveyance rollers to transport the sheets, and the fixing device 20, driven by the drive unit 204.

In the idle driving according to the present embodiment, in addition to the development device 13, the photoreceptor drum 11 and other driven members are driven at idle, without contributing to image forming processes or sheet conveyance. If the development device 13 only is driven at idle while the photoreceptor drum 11 is not driven (not rotating), the surface of the photoreceptor drum 11 can be locally damaged by sliding contact with developer carried on the development roller 13*a*. Such inconveniences may occur also between the photoreceptor drum 11 and the driven members (hereinafter "photoreceptor-related driven members"), such as the charging roller 11, a cleaning roller, and the like, that contact the photoreceptor drum 11. Therefore, in the present embodiment, at least the photoreceptor drum 11 and the photoreceptor-related driven members are also driven at idle in the idle driving.

It is to be noted that, if there are separate two drive units, the first for the photoreceptor drum 11 and the photoreceptor-related driven members and the second for sheet conveyance, it is preferable that, in the idle driving, it is not necessary to operate the second one from the above-described reason.

Figure 7A:
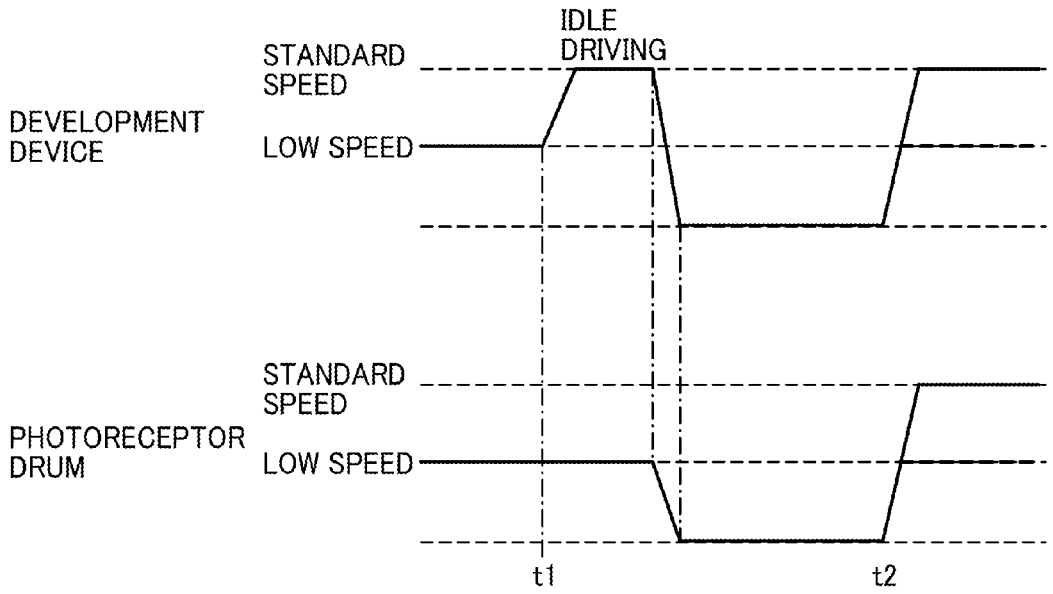
FIG. 7A is a timing chart illustrating driving velocities of the development device and the photoreceptor drum in a control according to an embodiment, when low-speed image formation is performed.
Figure 7B:
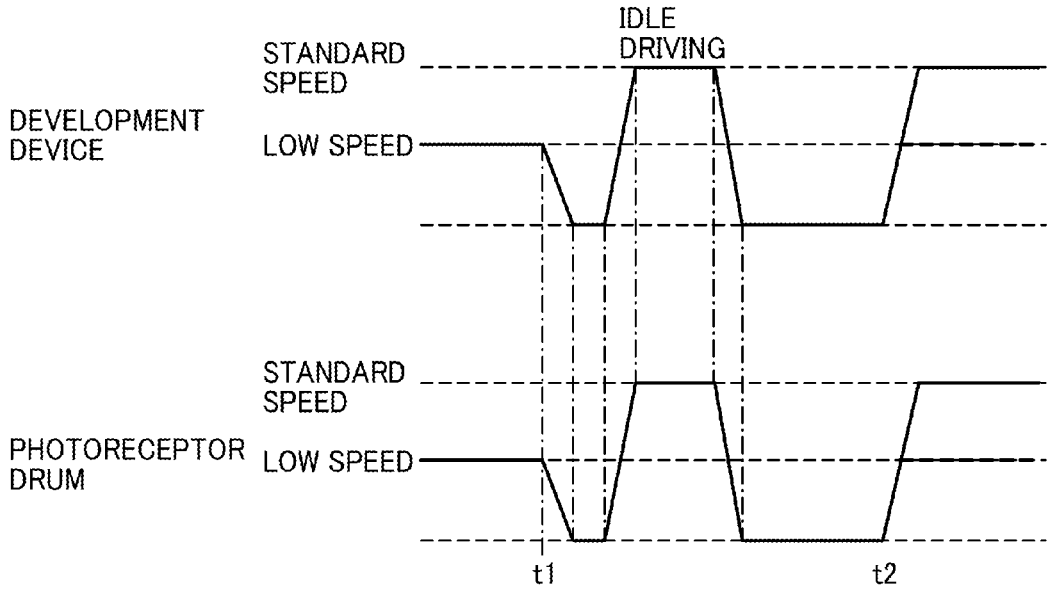
FIG. 7B is a timing chart illustrating driving velocities of a comparative development device.

FIG. 7A is a graph illustrating changes in the driving velocities of the development device 13 (the development roller 13*a* and the first and second conveyance screws 13*b*1 and 13*b*2) and those of the photoreceptor drum 11 and other driven members after a low-speed job is started in the present embodiment. FIG. 7B is a graph that illustrate changes in the driving velocities in a comparative example, in which driving is temporarily stopped in transition from the low-speed mode to the idle driving, and the photoreceptor drum 11 and other driven members are driven at the higher velocities during the idle driving, similarly to the development device 13.

In FIGS. 7A and 7B, the idle driving is executed at a time point t1, after which high-speed image development starts at a time point t2.

Referring to FIG. 7A, in the idle driving according to the present embodiment, the photoreceptor drum 11 and other driven members are driven at idle, at a velocity lower than the standard velocity. Specifically, in the idle driving, the driving velocity of the development device 13 is higher (equal to the standard velocity in the present embodiment), whereas the driving velocities of the photoreceptor drum 11 and other driven members are kept at the lower velocities. Additionally, in transition from the low-speed mode to the idle driving, driving of the development device 13 is not stopped but continued. Similarly, the photoreceptor drum 11 and other driven members are not stopped but driven at the lower velocities.

Compared with the comparative example shown in FIG. 7B, as shown in FIG. 7A, the control according to the present embodiment can shorten the duration from when the low-speed image development completes to when the entire image forming apparatus 1 stops after completion of the idle driving. Additionally, when the deceleration time and acceleration time caused by switching of the operation mode are included, the control according to the present embodiment can reduce the driving time (i.e., running distance) of the development device 13, the photoreceptor drum 11, and other driven members. Accordingly, the mechanical lives thereof can be extended. Additionally, the control according to the present embodiment can obviate the necessity to interrupt driving of those components during transition between the modes. Accordingly, users do not mistakenly deem the interruption malfunction of the apparatus.

As described above, in the configuration including the first and second conveyance screws 13*b*1 and 13*b*2, serving as the multiple developer conveyance members, arranged vertically and facing the development roller 13*a* serving as the developer bearer, when high-speed image development, in which the developer bearer and the multiple developer conveyance members are driven at higher velocities, proceeds from low-speed image development, idle driving in which driving velocity of at least the multiple developer conveyance members is higher than that for low-speed image development can be executed for a given period after low-speed image development is completed. Thus, image failure such as the above-described image density unevenness can be inhibited even when high-speed image development proceeds from low-speed image development.

Additionally, the number of the developer conveyance members are not limited to two but can be three or greater as long as at least two of them (serving as the supply screw and the collecting screw, respectively) are disposed facing the development roller.

Additionally, in the description above, the second conveyance screw 13*b*2 serving as the collecting screw is disposed above the second conveyance screw 13*b*1 serving as the supply screw, and the doctor blade 13*c* is disposed beneath the development roller 13*a*. However, the configurations to which the features of the present invention are applicable are not limited thereto but can include configurations in which the collecting screw is disposed beneath the supply screw, and the doctor blade 13*c* is disposed above the development roller 13*a*.

Also, the number of magnetic poles (e.g., H1 through H6) formed around the development roller is not limited to six but can be less or greater than six.

By performing the idle driving also in such configurations, similar effects can be attained.

Additionally, although only fresh toner is supplied from the toner container 28 to the development device 13 in the description above, alternatively, premixed fresh developer including toner and carrier may be supplied from a developer container to the development device 13. In this configuration, the development device 13 may further include a member to discharge excessive developer or used developer from the development device 13. In such a configuration, similar effects can be also attained.

Additionally, the above-described features of the present invention can adopt to either of configurations in which the development device 13 is independently installed or removed from the image forming apparatus or at least two components of the image forming unit 6 are housed in a process cartridge (modular unit) removably installed in the apparatus body. When the image forming unit is configured as such a process cartridge, maintenance work can be facilitated.

Additionally, the driving velocity of the development device 13 during the idle driving is not necessarily identical or similar to the velocity for standard-speed image development although it is in the present embodiment. Alternatively, the driving velocity of the development device 13 during the idle driving can be lower or higher than the driving velocity for standard-speed image development as long as it is higher than the velocity for the low-speed mode.

Additionally, although the development roller 13*a* is rotated in addition to the first and second conveyance screws 13*b*1 and 13*b*2 during the idle driving in the present embodiment, alternatively only the first and second conveyance screws 13*b*1 and 13*b*2 may be driven during the idle driving if the development roller 13*a* and the first and second conveyance screws 13*b*1 and 13*b*2 are driven by separate driving sources. Also in such configurations, similar effects can be attained.

According to the present embodiment, idle driving that involves driving at least the multiple developer conveyance members at a velocity higher than that for the low-speed image development for a predetermined time period is executed after low-speed image development is completed. Thus, the present embodiment can attain a development device, a process cartridge, and an image forming apparatus capable of inhibiting image failure such as the above-described image density unevenness caused under the above-described conditions even when high-speed image development, in which the developer bearer and the multiple developer conveyance members are driven at higher velocities, sequentially proceeds from low-speed image development.

(Second Embodiment)

Image forming units each incorporating a development device according to a second embodiment is described below.

Except the differences described below, the image forming units and the development device according to the second embodiment have configurations similar to those of the first embodiment.

Figure 8:
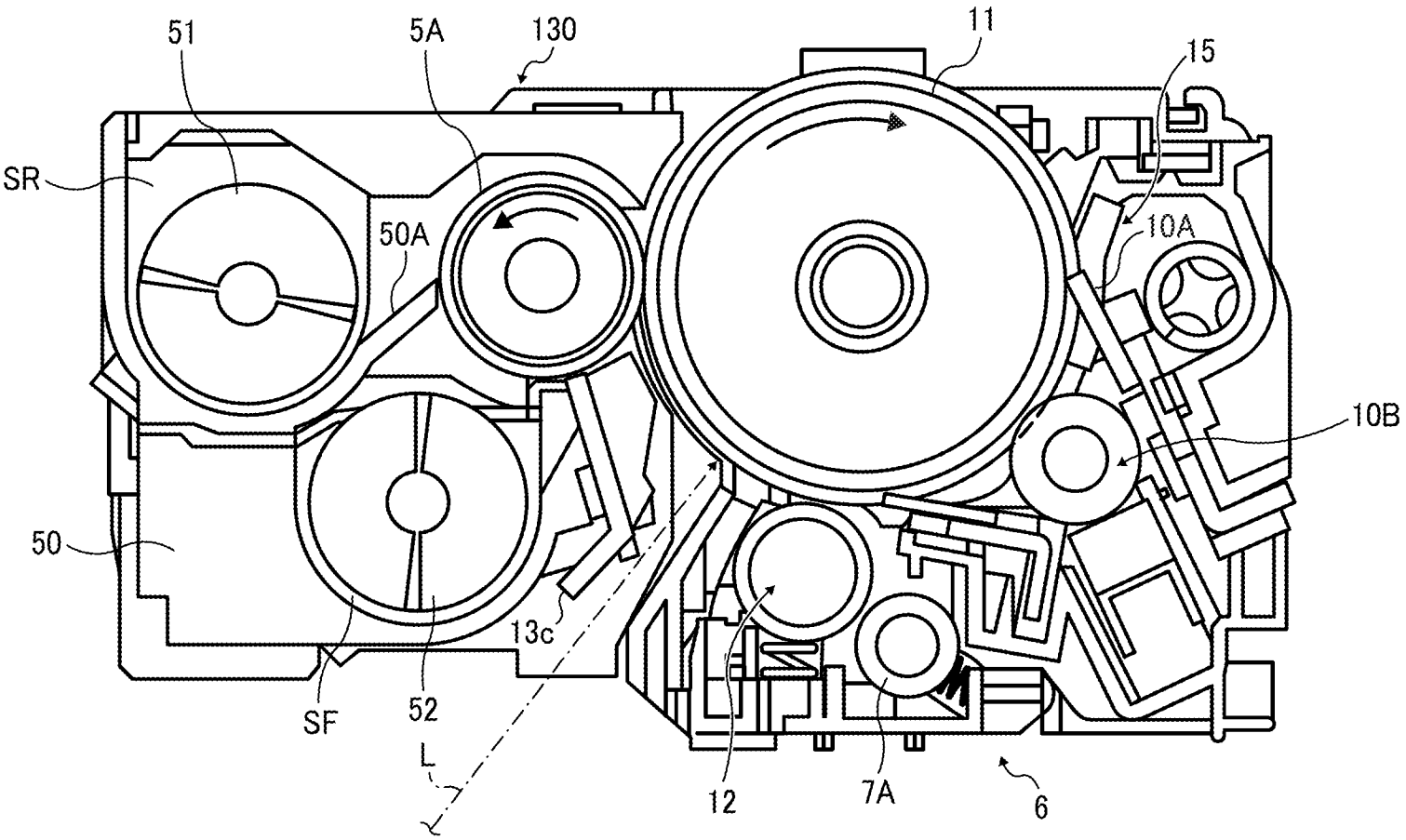
FIG. 8 is an end-on axial view of a process cartridge according to another embodiment.

FIG. 8 illustrates a configuration of the image forming unit 6 (hereinafter also "process cartridge 6"). Referring to FIG. 8, each image forming unit 6 is configured as a process cartridge (i.e., a modular unit) removably mounted in the apparatus body 1 shown in FIG. 1.

Inside the process cartridge 6, a photoreceptor drum 11 is provided, and around the photoreceptor drum 11, a charging unit 12, a writing unit to emit a writing beam L, a development device 130, and a cleaning unit 15 for performing the image forming processes are arranged in the order indicated by arrow shown in FIG. 8.

As the charging unit 12, for example, a roller capable of rotating adjacent to the photoreceptor drum 11 is used. The cleaning unit 15 includes, for example, a cleaning blade 10A to remove toner from the photoreceptor drum 11 after the transfer process and a lubricant applicator 10B to lubricate the photoreceptor drum 11 to reduce the friction coefficient thereof. In FIG. 8, further a cleaning roller 7A to clean the charging roller of the charging unit 12 is provided.

In the configuration shown in FIG. 8, the development device 130 includes a developer chamber 50 for containing developer therein, a development sleeve 5A disposed inside the developer chamber 50 and serving as a developer bearer, first and second conveyance screws 51 and 52 disposed adjacent to the development sleeve 5A, in vertically arranged developer conveyance channels in the developer chamber 50 separated by a partition 50A, and a doctor blade 13*c* facing a lower circumferential surface of the development sleeve 5A, to adjust a toner layer thickness.

Figure 9A:
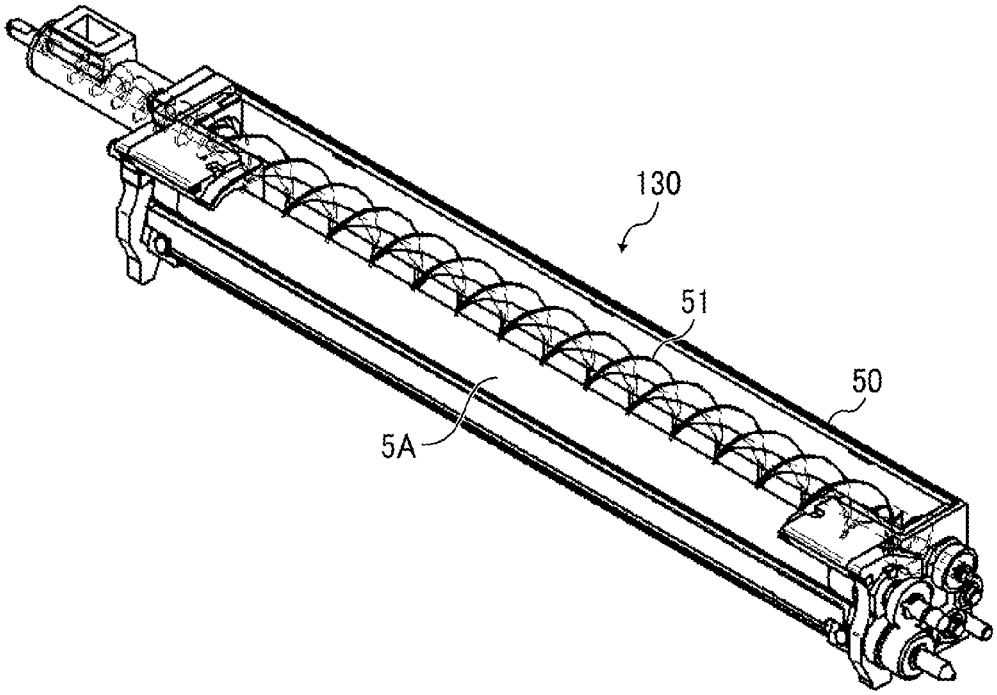
FIGS. 9A and 9B are respectively a perspective view and an end-on axial view of a development device according to another embodiment, incorporated in the process cartridge shown in FIG. 8.
Figure 9B:
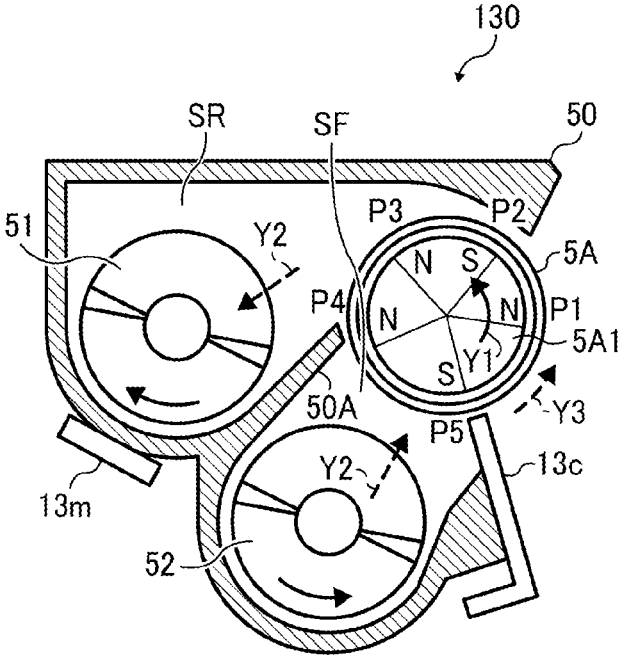

As shown in FIG. 9B, the development sleeve 5A is disposed on an outer circumference side of a magnet roller 5A1, and the magnet roller 5A1 includes five magnetic poles P1 through P5 in the circumferential direction, indicated by arrow Y1. The development sleeve 5A is rotatable relative to the magnet roller 5A1. In FIG. 9B, developer is transported by the moves from the first and second conveyance screws 51 and 52 to and from the development sleeve 5A as indicated by arrow Y2. The development sleeve 5A carries developer in the direction indicated by arrow Y3.

The respective magnetic poles P1 through P5 of the magnet roller 5A1 generate the magnetic force lines of North pole (N) or south pole (S) according to the polarity arrangement shown in FIG. 9B. As the development sleeve 5A rotates, carrier in the magnetic brush formed along the magnetic force lines roll on the circumferential surface of the development sleeve 5A.

As shown in FIG. 9B, the developer chamber 50 includes conveyance channels SR and SF separated by the partition 50A vertically in FIG. 9B. Developer is collected from the development sleeve 5A to the upper conveyance channel SR (hereinafter also "collecting channel SR"), and developer is supplied from the lower conveyance channel SF (hereinafter "supply channel SF") to the development sleeve 5A. Additionally, a toner concentration detector 13*m* is provided to the development device 130.

The first and second conveyance screws 51 and 52 are provided in the collecting channel SR and the supply channel SF, respectively. The first and second conveyance screws 51 and 52 are, for example, screw augers disposed with their axial directions in parallel to each other and designed to transport and agitate developer axially while rotating.

The first conveyance screw 51 in the collecting channel SR serves as a developer collecting member, and the second conveyance screw 52 in the supply channel SF serves as a developer supply member.

Figure 10A:
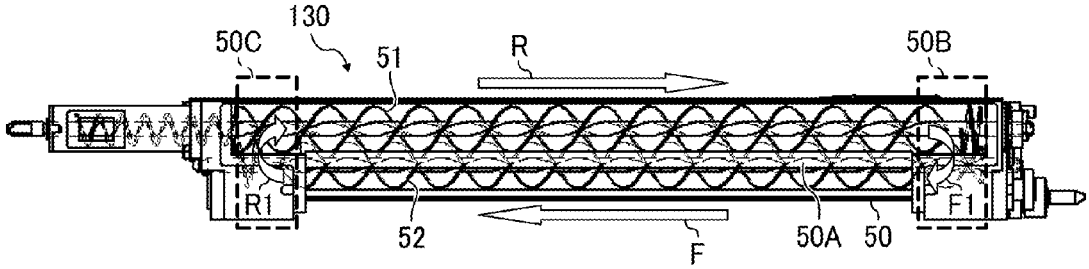
FIGS. 10A and 10B illustrate a configuration of a developer conveyance member of the development device shown in FIGS. 9A and 9B.
Figure 10B:
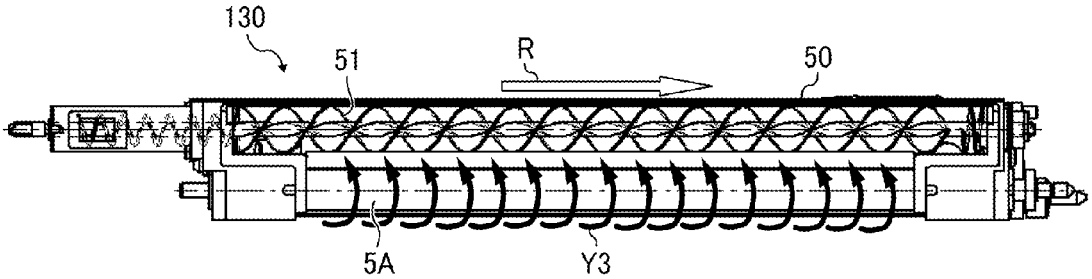

FIG. 10A illustrates the first and second conveyance screws 51 and 52 without the development sleeve 5A, and FIG. 10B illustrates movement of developer on the development sleeve 5A together with the first and second conveyance screws 51 and 52.

Referring to FIG. 10A, in both ends in the direction indicated by arrows R and F, in which the first and second conveyance screws 51 and 52 transport developer, the partition 50A is absent, thus forming communication areas 50B and 50C through which the collecting channel SR and the supply channel SF communicate with each other.

In the above-described configuration, developer moves in the axial direction of the first and second conveyance screws 51 and 52 as indicated by arrows F, F1, R, and R1 shown in FIGS. 10A and 10B and further moves via the communication areas 50B and 50C to the other conveyance channel. Thus, developer circulates unidirectionally in the development device 130.

In the present embodiment, the developer chamber 50 contains two-component developer in which toner and carrier is uniformly mixed to attain a percent by weight of about 7%. For example, toner has a particle size of about 5.8 μm and includes polyester resin as a main component, and carrier has a particle size of about 35 μm.

In the developer chamber 50, toner is charged frictionally while being agitated and transported by the first and second conveyance screws 51 and 52 in the collecting channel SR and the supply channel SF. Developer is circulated unidirectionally while thus charged frictionally.

Each of the first and second conveyance screws 51 and 52 includes reverse blade portions disposed facing the communication areas 50B and 50C to facilitate flow of developer. In the reverse blade portion, the direction of winding of the screw blade is reversed from the direction of the rest of the blade for transporting developer inside the collecting channel SR or the supply channel SF.

Accumulation of developer transported by the first and second conveyance screws 51 and 52 changes in the direction in which developer moves.

Figure 11:
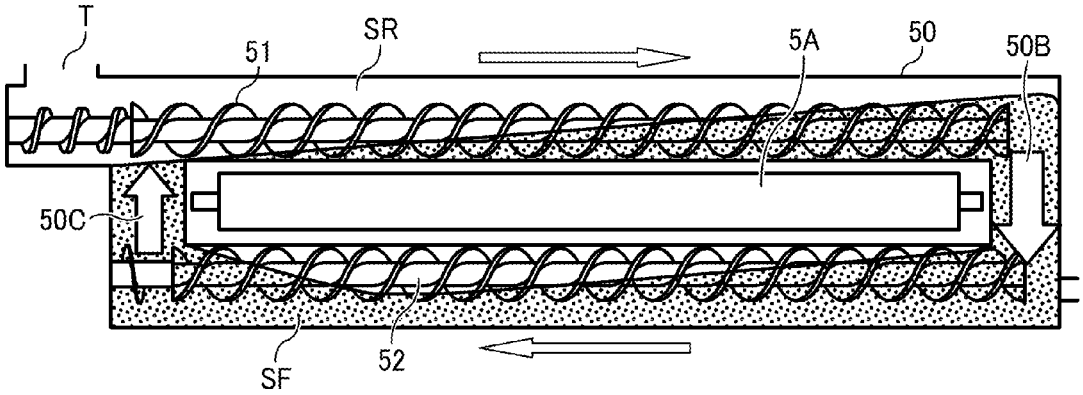
FIG. 11 is a schematic diagram illustrating flow of developer inside the development device shown in FIGS. 9A and 9B.

FIG. 11 illustrates accumulation of developer inside the collecting channel SR and the supply channel SF in which the first and second conveyance screws 51 and 52 are provided, respectively.

Referring to FIG. 11, the amount of developer inside the supply channel SF decreases downstream in the conveyance direction therein. By contrast, the amount of developer inside the collecting channel SR increases downstream in the conveyance direction therein. Thus, the level of developer is inclined.

A developer conveyance amount Wm in the supply channel SF can be obtained from the diameter and the pitch of the screw of the second conveyance screw 52 (developer supply member) and rotational frequency of the second conveyance screw 52. When the developer conveyance amount Wm is greater than the amount by an amount Ws by which developer is conveyed by the development sleeve 5A (Wm>Ws), developer can be uniformly supplied to the development sleeve 5A.

Toner added to adjust the concentration of toner in developer is supplied through a supply inlet T (shown in FIG. 11) provided in the collecting channel SR and agitated together with developer collected from the development sleeve 5A.

Then, developer is forwarded through the communication area 50B positioned in one end in the developer conveyance direction to the supply channel SF and further forwarded through the communication area 50C positioned in the other end in the developer conveyance direction to the collecting channel SR.

For example, the diameter of the shaft of each of the first and second conveyance screws 51 and 52 is about 6 mm to 10 mm, and the screw blade provided to the shaft has an external diameter of about 20 mm with a screw pitch of about 40 mm. The first and second conveyance screws 51 and 52 can be either single threaded or double threaded. The rotational frequency thereof is about 600 revolutions per minute (rpm) to 900 rpm for standard image formation.

A specific feature of the present embodiment is described below.

Similarly to the first embodiment, the development device 130 according to the second embodiment can operate in different speed modes, low-speed mode for low-speed image development and high-speed mode high-speed image development. In the present embodiment, low-speed mode can be selected for forming high-quality images or forming images on thicker paper, and high-speed mode can be selected for standard image formation.

Changes in image formation speed can affect the developer amount balance in the developer conveyance channels, particularly when high-speed image formation proceeds immediately from low-speed image formation. Referring to FIG. 11, if the developer amount balance in the supply channel SF and the collecting channel SR is disturbed, it is possible that developer overflows in the developer collecting channel and that developer becomes insufficient in the supply channel.

In view of the foregoing, an aim of the present embodiment is to provide a development device capable of securing a proper developer amount balance immediately after the speed is changed from the lower speed to the higher speed, and a process cartridge and an image forming apparatus that incorporate the development device.

Specifically, in the second embodiment, When high-speed image formation (i.e., high-speed mode) is to be performed after completion of low-speed image formation (i.e., a low-speed mode"), immediately the development device is driven at a higher speed before the subsequent high-speed image formation (i.e., high-speed job) is performed. In other words, the present embodiment is characterized in that, when high-speed image formation proceeds sequentially from low-speed image formation, the image forming apparatus 100 is operated in a mode to adjust the developer amount balance (hereinafter "developer amount balance adjustment").

With this control, changes in the developer amount balance between the supply channel SF and the collecting channel SR can be inhibited when high-speed image formation proceeds sequentially from low-speed image formation.

Referring to FIG. 11, if the operation mode is switched to the high-speed mode after a state in which developer is conveyed under conditions to prevent shortage of developer in the supply channel SF in the low-speed mode, developer moves in the supply channel SF and the collecting channel SR at a speed different from the speed until then.

More specifically, if the developer conveyance velocity changes abruptly in the supply channel SF and the collecting channel SR, the developer conveyance amount therein changes. In particular, the amount of developer in the supply channel SF decreases more greatly, resulting in image density unevenness.

Then, in the supply channel SF, the supply amount sufficient for low-speed image formation does not satisfy the supply amount for high-speed image formation, and shortage of developer, shortage of toner in particular, occurs. Simultaneously, the amount of developer collected in the collecting channel SR increases from the amount during low-speed image formation, and there is a risk of overflow. It is to be noted that, after the image formation speed is changed from the lower speed to the higher speed, the amount of developer in the supply channel SF and the collecting channel SR can be equalized with elapse of subsequent image formation.

In view of the foregoing, in the present embodiment, at the start of high-speed image formation proceeding sequentially from low-speed image formation, the developer amount balance adjustment involving driving of the respective components of the development device 130 is executed for a predetermined period.

This control can secure the developer amount balance for high-speed image formation in the supply channel SF and the collecting channel SR, thereby inhibiting leakage of developer and image failure caused by shortage of developer, more specifically, shortage of toner.

Figure 12:
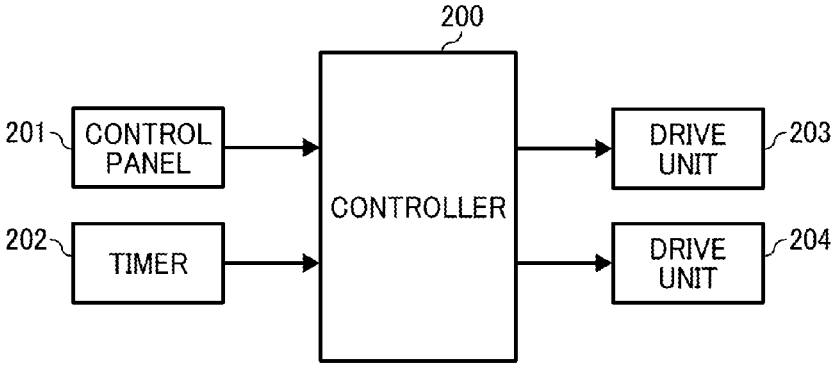
FIG. 12 is a block diagram illustrating a control circuitry for the development device according to an embodiment.

FIG. 12 is control circuitry for performing the developer amount balance adjustment when the operation mode is switched.

It is to be noted that FIG. 12 illustrates only portions relating to the present embodiment. In the configuration shown in FIG. 12, the controller 200 can be a processor for controlling image forming sequence. The control panel 201 via which the operation mode is selected and the timer 202 are connected to an input side of the controller 200. The drive unit 203 for driving the components of the development device 130 and the drive unit 204 to drive the components provided in the apparatus body 1, such s the photoreceptor drum 11, are connected to an output side of the controller 200.

When the high-speed image formation is selected subsequent to low-speed image formation via the control panel 201, the controller 200 executes the developer amount balance adjustment before high-speed image formation is started. The timer 202 measures the elapse of time after the developer amount balance adjustment is started.

Figure 13:
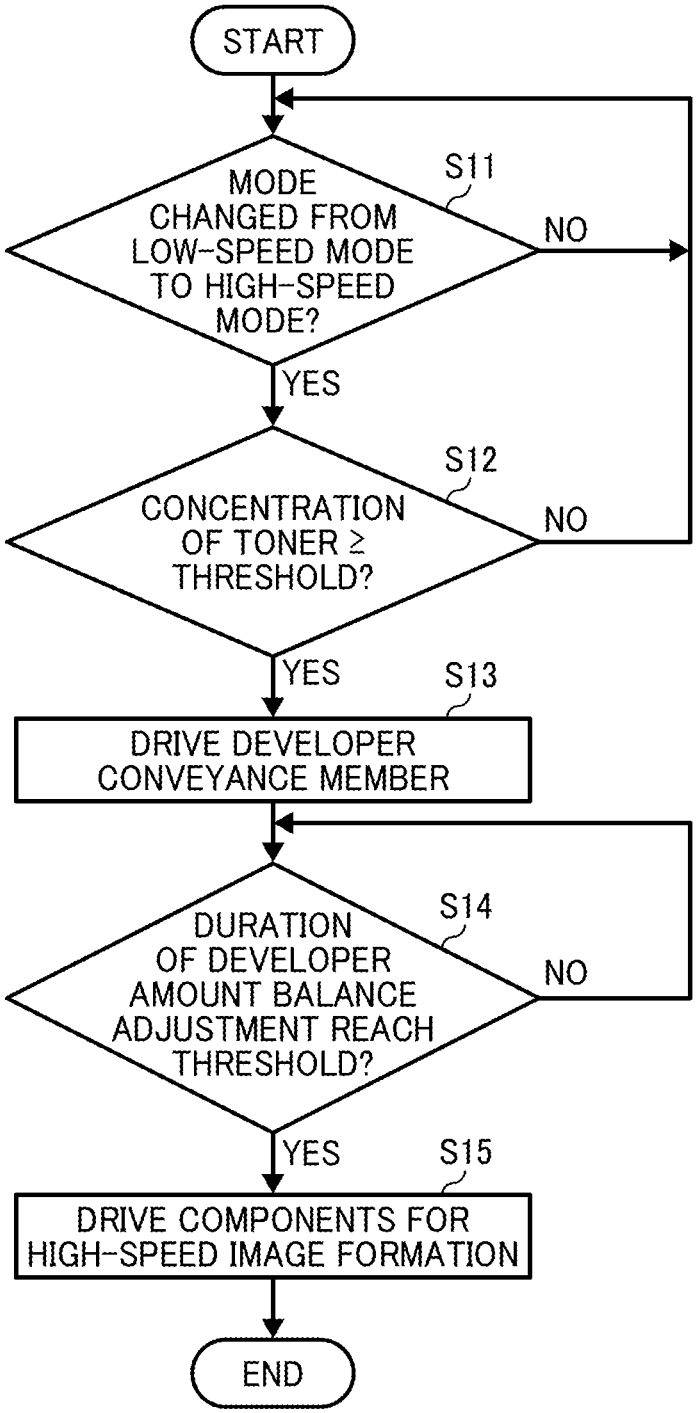
FIG. 13 is a flowchart of operation sequence according to an embodiment, controlled by the control circuitry shown in FIG. 12.

FIG. 13 is a flowchart of operation sequence controlled by the control circuitry shown in FIG. 12.

Referring to FIG. 13, at S11 the controller 200 determines whether the image formation mode changed from the low-speed mode to the high-speed mode according to input via the control panel 201.

When the operation mode is not switched to the high-speed mode (No at S11), low-speed image formation is performed. The determination at S11 is not limited to designation of the operation mode but can be made according to on-off input of a switch. When it is deemed that the low-speed mode is switched to the high-speed mode (Yes at S11), at S13, at least the first and second conveyance screws 51 and 52, which are members for correcting the developer amount balance in the supply channel SF and the collecting channel SR, are driven for a predetermined time (threshold).

With this control, while developer is conveyed in the supply channel SF and the collecting channel SR by the first and second conveyance screws 51 and 52 rotating at the high speed, the developer amount balance can be adjusted to that for high-speed image formation.

At S14, the controller 200 determines whether the duration of time of the developer amount balance adjustment reaches the predetermined period (i.e., the threshold) based on the measurement by the timer 202. When the predetermined period has elapsed (Yes at S14), the development device 130 and the other components are driven for high-speed image formation.

Effects attained by the present embodiments were experimentally confirmed as follows.

Table 2 shows configurations of the present embodiment and comparative examples 1 through 5 and confirmation results of effects attained by the developer amount balance adjustment.

TABLE 2

| | TONER CONCEN-TRATION | WEIGHT OF TONER (g) | RUN TIME OF IDLE DRIVING (S) | IMAGE FAILURE |
|---|---|---|---|---|
| COMPARATIVE EXAMPLE 1 | 7 | 400 | 0 | GOOD |
| COMPARATIVE EXAMPLE 2 | 6 | 395 | 0 | GOOD |
| COMPARATIVE EXAMPLE 3 | 5 | 391 | 0 | SLIGHT UNEVEN-NESS |
| COMPARATIVE EXAMPLE 4 | 4 | 387 | 0 | BAD |
| COMPARATIVE EXAMPLE 5 | 4 | 387 | 1.0 | BAD |
| EMBODIMENT 1 | 4 | 387 | 1.5 | GOOD |

Regarding the evaluation of "image failure" shown in Table 2, "good" means that image density unevenness is not observed, "slight unevenness" means that there is slight unevenness caused by shortage of developer, and "bad" means the image density is unacceptably uneven due to shortage of developer.

In the above-described embodiment, shortage of developer as well as overflow of developer can be inhibited by driving the first and second conveyance screws 51 and 52, which are the existing components, at the higher velocity for the predetermined period. Thus, shortage and overflow of developer can be inhibited by a simple configuration.

Additionally, the above-described developer amount balance adjustment may be executed depending on the density of developer, that is, the concentration of toner in developer.

Specifically, when high-speed image formation proceeds sequentially from low-speed image formation and when the concentration of toner is lower than the threshold, the developer amount balance adjustment can be executed compulsively.

With this control, shortage of developer in the supply channel SF, more specifically, the resultant image failure, can be prevented from the following factors.

Although the amount of developer is still unbalanced, that is, the level of developer is inclined in the developer conveyance direction as described with reference to FIG. 11 during low-speed image formation, the inclination changes with the concentration of toner. In other words, the level of developer changes depending on the amount of toner therein.

Therefore, when the amount of toner decreases and the concentration of toner is lower, the unevenness in the amount is more significant. Accordingly, on the downstream side in the supply channel SF in the developer conveyance direction, the desired amount for high-speed image formation is not distributed.

In view of the foregoing, in the present embodiment, when high-speed image formation proceeds sequentially from low-speed image formation, the concentration of toner is detected, and the developer amount balance adjustment is executed depending on the detected toner concentration, thereby shortage of developer on the downstream side in the supply channel SF is resolved.

Thus, the step S12 is added in the flowchart after the determination of changes in the image formation mode at S11.

As described above, in the second embodiment, when the image formation speed is changed from a lower speed to a higher speed, the developer amount balance adjustment is performed before the start of image formation at the higher speed, and, in the developer amount balance adjustment, at least the first and second developer conveyance members are driven at a velocity higher than the lower velocity for the predetermined period. Accordingly, images can be produced after the developer amount balance is adjusted compulsively.

Although the above-described embodiments concerns two image formation modes, the low-speed mode and high-speed mode (standard-speed mode), the features of the above-described embodiment can adapt to in configurations including multiple stepwise image formation modes, such as low-speed mode, moderate-speed mode, and high-speed mode.

In such cases, the developer amount balance adjustment can be executed at the start of the higher speed mode sequentially proceeding from the lower speed mode or when the concentration of toner is lower.

It is to be noted that the concentration of toner, which is one of the criteria to judge whether to execute the developer amount balance adjustment, depends on the size of the development device, the rotational frequency of the screw, and the like, and it is desirable to calculate the amount of toner for the desirable concentration during high-speed image development through a preliminary experiment. Similarly, it is desirable to calculate the relation between the run time of the developer amount balance adjustment and the velocity through a preliminary experiment.

It is to be noted that, the sequence of determination of toner concentration and run time in the above-described flowcharts 6 and 13 may be reversed.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop a latent image formed on a latent image bearer with two-component developer contained therein, the development device comprising:

a partition dividing, at least partly, an interior of the development device into a supply channel and a collection channel;

a developer bearer to carry developer and disposed facing the latent image bearer;

a developer regulator to adjust an amount of developer carried on the developer bearer; and multiple developer conveyance members to transport developer in a longitudinal direction of the development device and circulate developer therein, the multiple developer conveyance members including first and second conveyance members disposed facing the developer bearer, the first developer conveyance member to supply developer to the developer bearer, the second developer conveyance member to transport developer collected from the developer bearer in the collecting channel, wherein the development device is operable in multiple different speed modes and performs developer amount balance adjustment in which a driving velocity of at least the multiple developer conveyance members is increased from a driving velocity in a lower-speed mode, and the development device executes the developer amount balance adjustment for a predetermined period after image development in the lower speed mode is completed and before image development in a higher speed mode is started.

2. The development device according to claim 1, wherein the development device executes the developer amount balance adjustment immediately after image development in the lower speed mode is completed.

3. The development device according to claim 1, further comprising a toner concentration detector to detect a concentration of toner in developer contained in the development device, wherein the developer amount balance adjustment is executed when the concentration of toner detected by the toner concentration detector is equal to or lower than a threshold.

4. The development device according to claim 1, wherein the developer amount balance adjustment is executed when duration of image development in the lower speed mode is equal to or longer than a threshold.

5. The development device according to claim 1, wherein, in the developer amount balance adjustment, each of the developer bearer and the multiple developer conveyance members is driven at a velocity equal to a velocity in the higher speed mode.

6. The development device according to claim 1, wherein the developer amount balance adjustment is executed at the start of image development in the higher speed mode.

7. The development device according to claim 6, further comprising a toner concentration detector to detect a concentration of toner in developer contained in the development device, wherein the developer amount balance adjustment is executed when the concentration of toner detected by the toner concentration detector is equal to or lower than a threshold.

8. A process cartridge removably installed in an image forming apparatus, the process cartridge comprising:

the latent image bearer; and the development device according to claim 1.

9. The process cartridge according to claim 8, wherein, in the lower speed mode, the latent image bearer is driven at a velocity lower than a velocity in the higher speed mode, and in the developer amount balance adjustment, the velocity of the latent image bearer is kept at the velocity in the lower speed mode.

10. The process cartridge according to claim 8, further comprising a driven member separate from the latent image bearer and the development device, wherein, in the lower speed mode, the driven member is driven at a velocity lower than a velocity in the higher speed mode, and in the developer amount balance adjustment, the velocity of the driven member is kept at the velocity in the lower speed mode.

11. An image forming apparatus comprising:

the latent image bearer; and the development device according to claim 1.

12. The image forming apparatus according to claim 11, wherein, in the lower speed mode, the latent image bearer is driven at a velocity lower than a velocity in the higher speed mode, and in the developer amount balance adjustment, the velocity of the latent image bearer is kept at the velocity in the lower speed mode.

13. The image forming apparatus according to claim 11, further comprising a driven member separate from the latent image bearer and the development device, wherein, in the lower speed mode, the driven member is driven at a velocity lower than a velocity in the higher speed mode, and in the developer amount balance adjustment, the velocity of the driven member is kept at the velocity in the lower speed mode.

* * * * *